US005829637A

United States Patent [19]

Takemura et al.

[11] Patent Number: 5,829,637

[45] Date of Patent: Nov. 3, 1998

[54] BAG-IN-CARTON AND METHOD AND DEVICE FOR FORMING THE BAG-IN-CARTON

[75] Inventors: Toru Takemura; Takeshi Morisako, both of Tokyo, Japan

[73] Assignees: Riso Kagaku Corporation; Dai Nippon Printing Co., Ltd., both of Japan

[21] Appl. No.: 722,229

[22] PCT Filed: Feb. 14, 1996

[86] PCT No.: PCT/JP96/00317

§ 371 Date: Oct. 9, 1996

§ 102(e) Date: Oct. 9, 1996

[30] Foreign Application Priority Data

| | | | |
|---|---|---|---|
| Feb. 15, 1995 | [JP] | Japan | 7-026750 |
| Feb. 15, 1995 | [JP] | Japan | 7-026822 |
| Feb. 15, 1995 | [JP] | Japan | 7-026829 |
| May 29, 1995 | [JP] | Japan | 7-130775 |
| May 29, 1995 | [JP] | Japan | 7-130802 |

[51] Int. Cl.[6] ..... B65D 17/06

[52] U.S. Cl. ..... 222/81; 222/95; 222/105

[58] Field of Search ..... 222/81, 83, 95, 222/105, 386.5, 90; 363/109, 119, 121, 906; 220/403, 443, 461

[56] References Cited

U.S. PATENT DOCUMENTS

| | | | |
|---|---|---|---|
| 2,052,445 | 8/1936 | Burns | 222/90 |
| 4,475,670 | 10/1984 | Rutter | 222/83 |
| 4,842,165 | 6/1989 | Van Coney | 222/95 |
| 5,156,295 | 10/1992 | Gordon et al. | 222/183 |
| 5,433,345 | 7/1995 | Sasaki et al. | 222/81 |
| 5,551,600 | 9/1996 | Sasaki et al. | 222/81 |
| 5,566,851 | 10/1996 | Sasaki et al. | 222/105 |

FOREIGN PATENT DOCUMENTS

| | | |
|---|---|---|
| 57-137140 | 8/1982 | Japan . |
| 4-135449 | 12/1992 | Japan . |
| 5-8329 | 1/1993 | Japan . |
| 5-22363 | 3/1993 | Japan . |
| 5-229571 | 9/1993 | Japan . |
| 6-1305 | 1/1994 | Japan . |
| 6-270964 | 9/1994 | Japan . |
| 7-257645 | 10/1995 | Japan . |

*Primary Examiner*—Andres Kashnikow
*Assistant Examiner*—Lisa Ann Douglas
*Attorney, Agent, or Firm*—Parkhurst & Wendel, L.L.P.

[57] ABSTRACT

A bag-in-carton 1 comprises a substantially rectangular parallelepiped carton 2, an inner bag 3 and a pouring spout 5 attached to an inclined panel of the carton 2. The inner bag 3 is adhered to inner-bag adhering regions 9 provided on the substantially entire parts of the inside surfaces of the inclined panel 2*g*, a pair of side panels 2*b*, 2*d* which are adjacent to the inclined panel 2*g*, and a side panel 2*a*. The inner bag 3 is also adhered partially to the inside surface of a side panel 2*c* which is remote from the incline panel 2*g*. When a content is drawn out through the pouring spout 5, the inner bag 3 is gradually released from the inside surface of the side panel 2 of the inside surface of the carton 2 and is deformed, moved to the pouring spout 5.

24 Claims, 18 Drawing Sheets

BAG-IN-CARTON AND METHOD AND DEVICE FOR FORMING THE BAG-IN-CARTON

BACKGROUND OF THE INVENTION

The present invention relates to a bag-in-carton with a flexible inner bag adhered to inside surfaces of a substantially rectangular parallelepiped carton, and a method and device for forming the bag-in-carton.

As a liquid packaging container bag-in-cartons have been conventionally used. The bag-in-carton usually has a rectangular parallelepiped having a flat bottom panel, a top panel, and four flat side panels between the bottom and the top panels. The inner bag is adhered to the inside surfaces of the four side panels. The bag-in-carton is generally used in packaging liquids of low viscosities, such as juice, liquor, etc. Practically when a content is discharged from the bag-in-carton, air corresponding to a discharged amount of the content enters the bag-in-carton.

When the bag-in-carton is used in packaging a liquid of high viscosity, such as ink, or others, it is necessary to draw the liquid through the pouring spout when the liquid is discharged from the bag-in-carton. But it is difficult to let air in the inner bag. Accordingly it is necessary to deform the inner bag to decrease its volume corresponding to a discharge of the content in the inner bag. The conventional bag-in-carton whose inner bag is adhered to the four inside surfaces of the carton cannot have the inner bag deformed when a content thereof is discharged, which makes it impossible to use the bag-in-carton as it is in packaging a liquid of high viscosity.

Furthermore, in using the bag-in-carton in packaging ink for printing machines, the pouring spout of the bag-in-carton is connected to the connector of a printing machine to discharge the content of the bag-in-carton.

To meet the purpose of feeding a constant amount of ink to a printing machine, it is necessary that an ink feed amount per a unit hour is stably constant.

The conventional bag-in-carton cannot have achievements to fulfill these functions, and the following achievements are required.

1) The inner bag is deformed as ink is drawn out.

2) An ink feed amount is stably constant.

SUMMARY OF THE INVENTION

In consideration of these disadvantages the present invention was made, and an object of the present invention is to provide a bag-in-carton which can suitably hold liquid of high viscosity, such as ink and is deformed as the liquid of high viscosity is discharged to thereby stably feed the ink, and a method and a device for forming the bag-in-carton.

A first characteristic feature of the present invention is a bag-in-carton comprising a substantially rectangular parallelepiped carton having a pouring spout mounting panel; a flexible inner bag disposed in the carton, for holding a content; and a pouring spout mounted on the pouring spout mounting panel of the carton and passed through the inner bag and the pouring spout mounting panel, the inner bag being adhered to insides of the carton.

A second characteristic feature of the present invention is the above-described bag-in-carton, wherein the inner bag is fixed by an adhesive to, of insides of the carton, a substantially entire surface of the inside of the pouring spout mounting panel of the carton and substantially entire surfaces of the insides of a pair of the opposed side panels which are adjacent to the pouring spout mounting panel, the inner bag being gradually released off the insides of the carton as the content is discharged out of the inner bag.

A third characteristic feature of the present invention is the above-described bag-in-carton, wherein the carton has one closed side portion and the other closed side portion which are opposed to each other; the inner bag has one seal-closed side portion and the other seal-closed side portion which correspond respectively to said one closed side portion of the carton and said the other closed side portion thereof; and said one seal-closed side portion of the inner bag has a shape corresponding to that of said one closed side portion of the carton.

A fourth characteristic feature of the present invention is the above-described bag-in-carton, wherein the the inner bag is formed of a tubular film which is prepared by folding a sheet of film into a tubular shape and sealing end edges thereof into a back sealed portion, the back sealed portion of the tubular film is disposed inside the panel of the carton opposed to the pouring spout mounting panel.

A fifth characteristic feature of the present invention is the above-described bag-in-carton, wherein the inner bag is secured by an adhesive to, of insides of the carton, a substantially entire surface of the inside of the pouring spout mounting panel; the inner bag is adhered to surfaces of a pair of opposed side panels of the carton, which are adjacent to the pouring pout mounting panel, except strips of the surfaces which are substantially normal to a straight line interconnecting the pouring spout and a remotest end part of the carton which are remotest from the pouring spout, and are located at a middle of the straight line, the inner bag is gradually released off the insides of the carton as the content is discharged.

A sixth characteristic feature of the present invention is the above-described bag-in-carton, wherein the inner bag is secured by an adhesive to, of insides of the carton, a substantially entire surface of an inside of the pouring spout mounting panel; the inner bag is adhered to surfaces of a pair of opposed side panels of the carton, which are adjacent to the pouring pout mounting side, except recesses in the surfaces which are extended substantially parallel with a straight line interconnecting the pouring spout and a remotest end part of the carton from the pouring spout, the inner bag is gradually released off the insides of the carton as the content is discharged.

A seventh characteristic feature of the present invention is the above-described bag-in-carton, wherein the inner bag is secured by an adhesive to, of insides of the carton, a substantially entire surface of the inside of the pouring spout mounting panel; the inner bag is adhered to the insides of a pair of opposed side panels of the carton, which are adjacent to the pouring spout mounting panel, the inner bag being adhered to substantially entire surface of the insides of the pair of opposed side panels on the side of the pouring spout with respect to a substantial middle of a straight line interconnecting the pouring spout and a remotest end part of the carton which are remotest from the pouring spout, and the inner bag being adhered to partially surfaces of the insides of the pair of opposed side panels on the side of the remotest end part, the inner bag is gradually released off the insides of the carton as the content is discharged.

An eighth characteristic feature of the present invention is the above-described bag-in-carton, wherein the inner bag is fixed to a substantially entire surface of an inside of the pouring spout mounting side panel of the carton; the inner bag is adhered to the insides of a pair of opposed side panels of the carton, which are adjacent to the pouring spout mounting side panel, in such a manner where the inner-bag adhering surfaces have areas decreasing gradually from the pouring spout to the remote end part, the inner bag is released off the insides of the carton as the content is discharged.

A ninth characteristic feature of the present invention is a method for forming a bag-in-carton comprising the step of adhering a flexible inner bag of tubular film having openings on both ends to a carton blank for a carton at a set position; the step of setting up the carton blank into a rectangular parallelepiped carton so that the carton has openings on both ends thereof; the step of sealing one side opening of said inner bag arranged in correspondence with one side opening of the carton to form one side seal-closed portion; the step of closing the one opening of the carton to form one side closed portion; and the step of inserting a forming jig into the inner bag through the other side opening of the carton and through the other side opening of the inner bag, pressing said one side seal-closed portion of the inner bag against said one side closed portion of the carton by the forming jig, and forming the shape of said one side seal-closed portion of the inner bag in accordance with that of said one side closed portion of the carton.

A tenth characteristic feature of the present invention is an apparatus for forming a bag-in-carton comprising means for setting up a carton blank for a carton with a flexible inner bag of tubular film having openings on both ends thereof into a rectangular parallelepiped carton so that the carton has openings on both ends thereof; means for sealing one side opening of the inner bag arranged in correspondence with one side opening of the carton to form one side seal-closed portion; means for closing said one side opening of the carton to form one side closed portion; and a forming jig which is to be inserted into the inner bag through the other side opening of the carton and through the other side opening of the inner bag and presses said one side seal-closed portion of the inner bag against said one side closed portion of the carton to form the shape of said one side seal-closed portion of the inner bag in accordance with that of said one side seal-closed portion of the carton.

According to the first and the second characteristic features of the present invention, when the content is drawn out through the pouring spout, the inner bag starts being released from the inner-bag adhering regions provided partially on the surfaces remote from the pouring spout attaching panel, and from the inner-bag adhering regions provided on the substantially entire inside surfaces of a pair of side panels opposed to each other. As the content is drawn, the inner bag is deformed and is moved to the pouring spout. The releasable part of the inner bag is withdrawn into the unreleasable part thereof to thereby discharge substantially all the content through the pouring spout. During this operation, the inner bag is uniformly deformed, with a result that the content is supplied stably and constantly.

According to the third characteristic, one seal-closed end of the inner bag is in agreement with one tight closed end of the carton, whereby the shape and a volume of the inner bag can be retained constant.

According to the fourth characteristic feature of the present invention, the back sealed portion of the tubular film is relatively hard. Because of the back sealed portion located on the inside surface of the panel opposed to the pouring spout attaching panel of the carton, when the content is drawn out through the pouring spout, the inner bag can be deformed horizontally symmetrically with respect to the pouring spout.

According to the fifth characteristic feature of the present invention, when the content is drawn out through the pouring spout, the inner bag starts being released from the inner-bag adhering regions provided on the inside surfaces of a pair of side panels of the carton opposed to each other. As the content is drawn out, the released part of the inner bag is deformed and moved to the pouring spout to be withdrawn into the unreleasable part of the inner bag which is adhered to the carton to thereby drive out substantially all the content through the pouring spout. In this operation, on the pair of the opposed side panels the release of the inner bag starts on the side of the remote end part and finishes at the strips, whereby the inner bag is uniformly deformed, and accordingly the content can be supplied stably and constantly.

According to the sixth characteristic feature of the present invention, the inner bag is adhered to the inside surfaces of a pair of side panels except cuts extended substantially parallel with a straight line interconnecting the pouring spout and the remote end part of the carton which is remotest from the pouring spout, the inner bag can be readily released on the side of the remote end part on the pair of side panels when the inner bag is released from the inside surfaces of the carton as the content of the inner bag is decreased.

According to the seventh characteristic feature of the present invention, the inner bag is adhered to the substantially entire parts of the inside surfaces of the pair of opposed side panels which (parts) are nearer to the pouring spout with respect to the substantial middle of a straight line interconnecting the pouring spout and the remote end part of the carton which is remotest from the pouring spout, and are partially adhered on the side of the remote end part. Accordingly when the inner bag is released from the inside surfaces of the carton as the content of the inner bag is decreased, the inner bag can be readily released from the pair of side panels first on the side of the remote end part.

According to the eighth characteristic feature of the present invention, the inner bag is adhered to the inside surfaces of the pair of opposed side panels so that the inner-bag adhering regions decrease an area gradually from the side of the pouring spout to the side of the remote end part, whereby the inner bag can be readily released from the pair of side panels first on the side of the remote end part when the inner bag is released from the inside surfaces of the carton.

According to the ninth and the tenth characteristic features of the present invention, one side seal-closed portion of the inner bag is pressed against one side closed portion of the carton by a having a jig, whereby a bag-in-carton having the one side-closed portion of the inner bag formed in accordance with the one side closed portion of the carton can be formed.

PREFERRED EMBODIMENTS OF THE INVENTION

A First Embodiment

The bag-in-carton according to a first embodiment of the present invention will be explained with reference to drawings attached hereto.

Figure 1A:
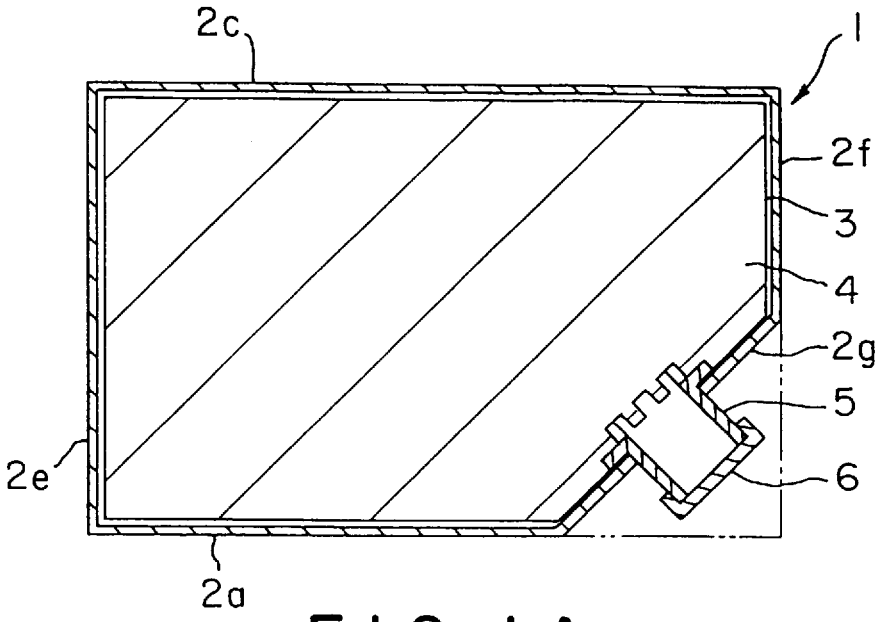
FIG. 1A is a side sectional view of the bag-in-carton according to a first embodiment of the present invention in its state where the bag-in-carton is filled with a content.
Figure 1B:
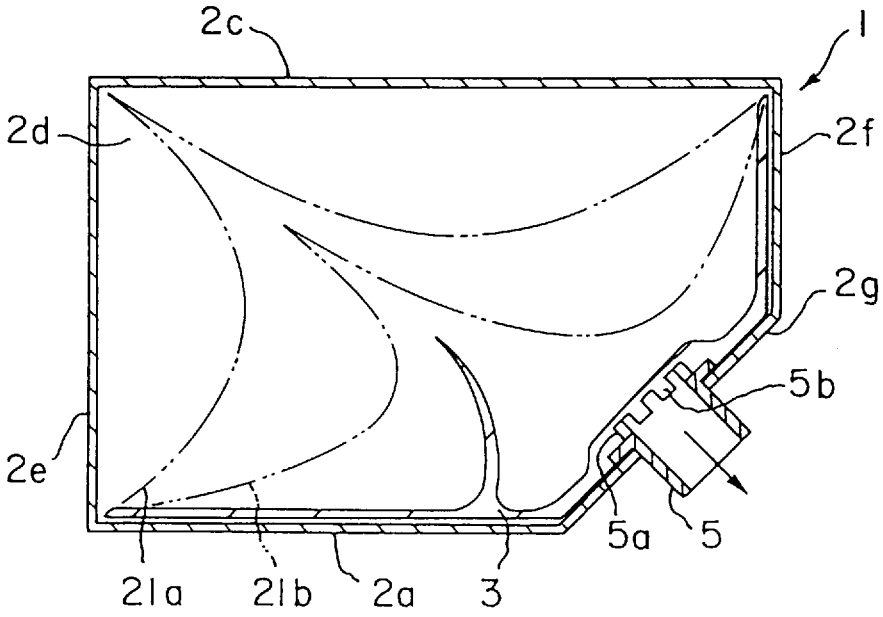
FIG. 1B is a side sectional view of the bag-in-carton according to the first embodiment of the present invention in its state where the content is drawn out.
Figure 2:
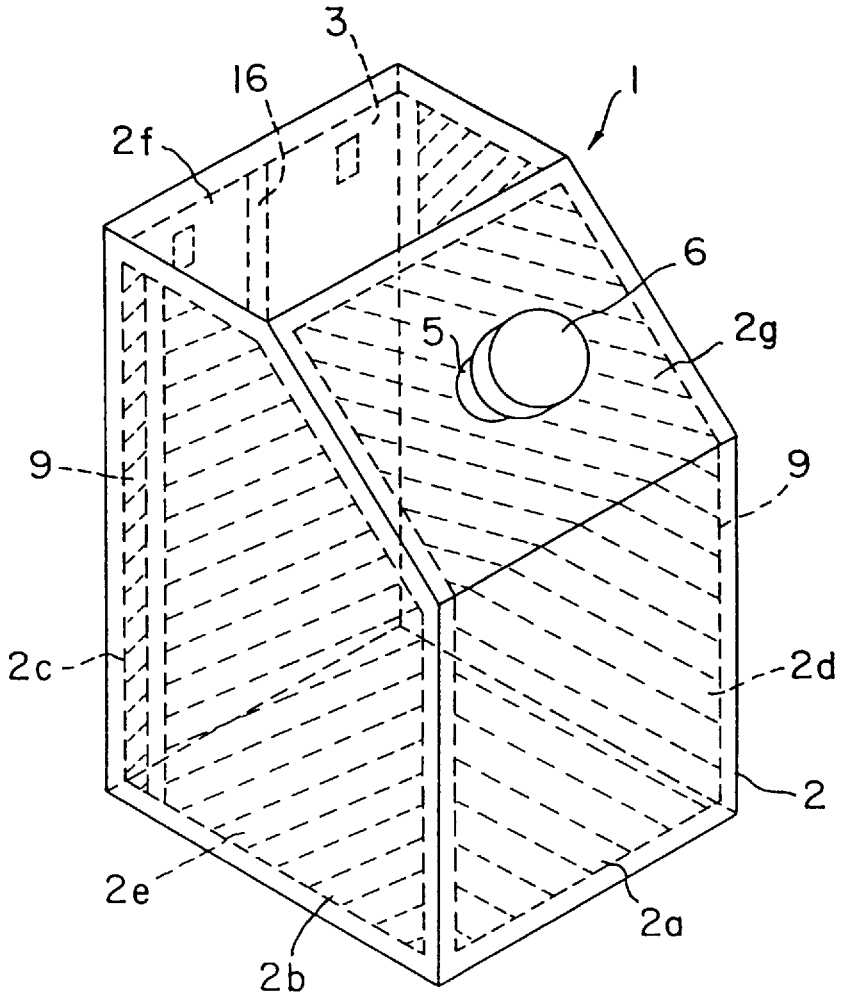
FIG. 2 is a diagrammatic perspective view of the bag-in-carton.

FIGS. 1 to 5 are views of the bag-in-carton according to the first embodiment of the present invention. FIG. 1A shows the bag-in-carton according to the first embodiment which is filled with a content, and FIG. 1B shows the bag-in-carton according to the first embodiment with the content drawn out. FIG. 2 is a diagrammatic perspective view of the bag-in-carton according to the first embodiment. In FIGS. 1A, 1B and 2, the bag-in-carton 1 comprises a substantially parllelepiped box-shaped carton 2 as an outer container, and a flexible inner bag 3 housed inside the carton 2. A content 4, such as ink, is held in the inner bag 3. The carton 2 includes an inclined panel between two panels of the rectangular parallelepiped and comprises four flat side panels 2*a*, 2*b*, 2*c*, 2*d*, a top and a bottom panels 2*f*, 2*e*, and the inclined panel 2*g* formed between the side panel 2*a* and the top panel 2*f*.

A pouring spout 5 is attached to the inclined panel 2*g* of the carton 2 in communication with the inner bag 3 and is closed by a cap 6. The pouring spout 5 has a tubular portion 5*a* extended in the inner bag 3 and has grooved passages 5*b* for passing the liquid formed in the end part of the tubular portion 5*a* on the side of the inner bag 3. Because of the passages 5*b*, even when, for example, the end of the tubular portion 5*a* in the inner bag 3 is blocked by the inner bag 3, the content 4 can be drawn out into the pouring spout 5 through the passages 5*b*. A projection height of the pouring spout 5 beyond the carton 2 is so set that the cap 6 put on the pouring spout 5 is within a region defined by an extension of the side panel 2*a* and an extension of the top panel 2*f*. This arrangement permits a number of the bag-in-cartons to be laid one on another and side by side in rows and columns.

The inner bag 3 is adhered fixedly to parts of the inside surfaces of the carton 2.

Figure 3:
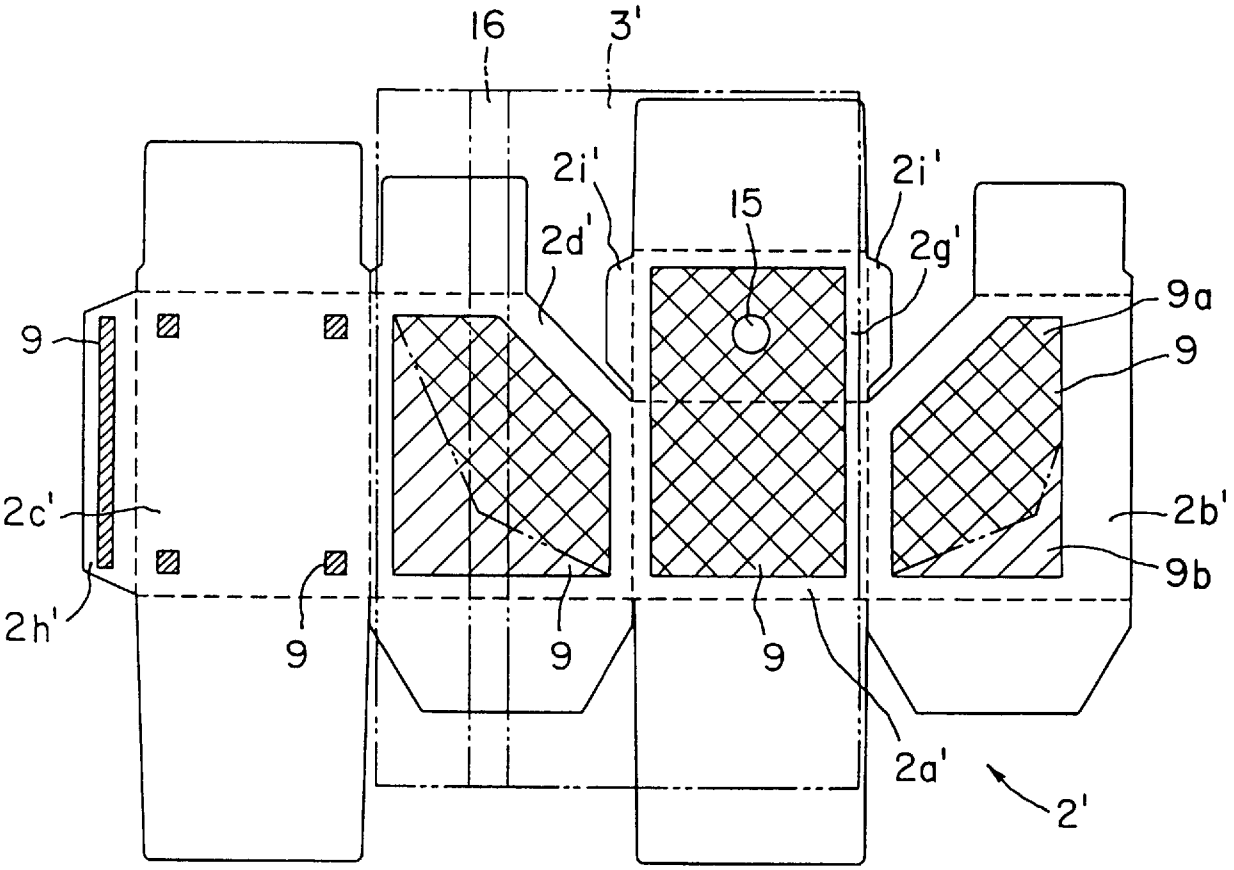
FIG. 3 is a diagrammatic plan view of a carton blank for the bag-in-carton, and a tubular film.

That is, as shown in FIGS. 1A to 3, the inner bag 3 is adhered to the substantially entire inside surfaces of the inclined panel (pouring spout attached panel) 2*g*, the pair of the opposed side panels 2*b*, 2*d* which are adjacent to the inclined panel 2*g* and the side panel 2*a* adjacent to the lower edge of the inclined panel 2*g*. The inner bag 3 may be adhered to the substantially entire inside surfaces of the inclined panel 2*g* and the side panel 2*a* at spots by an adhesive. The inner bag 3 is adhered to the four corners of the side panel 2*c* of the panels which are not adjacent to but remote from the inclined panel 2*g*. FIG. 2 shows the inner-bag adhering regions 9. FIG. 3 shows a carton blank 2' for the carton. In FIG. 3, the cross-hatched region of the inner-bag adhering regions 9 is a non-releasable region 9*a*, and the parallel hatched regions of the inner-bag adhering regions 9 are releasable regions 9*b*.

The inner bag 3 is thus adhered to the substantially entire inside surfaces of the inclined panel 2*g*, a pair of the side panels 2*b*, 2*d* and the side panel 2*a* below the inclined panel 2*g*, and partially to the inside surface of the side panel 2*c*, whereby the inner bag 3 can be firmly fixed in the carton 2. The inner bag 3 is adhered to the inside surfaces of the carton 2 by a releasable adhesive. As a result, as the content is discharged and decreased, the inner bag 3 is shrunk and easily released from the carton 2.

The inner bag 3 is spot-adhered to the inside surface of the side panel 2*c* at inner-bag adhered regions 9 provided on the four corners thereof. When the content 4 is discharged through the pouring spout 5, the inner bag 3 is gradually deformed to move toward the pouring spout 5. At this time, the inner bag 3 is released first from the side panel 2*c*, which is remote from the pouring spout 5, and the spot-adhesion of the inner bag 3 to the inside surface of the side panel 2*c* facilitates easy release of the inner bag 3 of f the side panel 2*c*. The inner-bag adhering regions 9 on the side panel 2*c* may be square as shown in FIG. 2 or rectangular.

Figure 4:
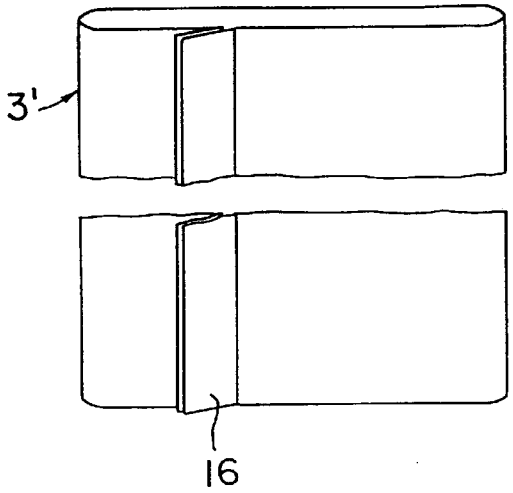
FIG. 4 is a diagrammatic plan view of the tubular film to be adhered to the bag-in-carton.

Then, a method for forming the bag-in-carton 1 having the above-described structure will be explained. First, a cardboard is punched in a prescribed shape as shown in FIG. 3 to prepare a carton blank 2' having panels 2*a*'–2h' to be set up into the carton. The inner-bag adhering regions 9 are formed on the inside surface of the panels 2*a*', 2*b*', 2*c*', 2*d*', 2*g*' (which are to be the side panels 2*a*, 2*b*, 2*c*, 2*d* and the inclined panel 2*g*). While the carton blank 2' is being formed, as shown in FIG. 4, a sheet film is folded into a tubular shape and back-sealed at end portions to form a back sealed portion 16. The folded film is cut into tubular films 3' of a required length (whose top and bottom ends will be sealed in a later step into the inner bags).

Then, an adhesive, e.g., an emulsion-type adhesive, as of vinyl acetate group, acryl copolymer group, vinyl acetate-acryl copolymer group, modified ester acrylate copolymer group, etc., is applied to the inner-bag adhering regions 9 which are formed on the substantially entire inside surfaces of the panels 2*a*', 2*b*', 2*d*' and 2*g*' of the carton blank 2'. The adhesive is applied to the inner-bag adhering regions 9 formed partially on the side panel 2*c*' and a glue margin 2*h*' of the carton blank 2'. A glue margin 2*i*' of the carton blank 2' is folded inside when the carton blank 2' is set up, and a hot-melt adhesive, as of ethylene-vinyl acetate copolymer group, polyvinyl acetate group, polyamide group, polyethylene group, styrene-butadiene copolymer group, styrene-isobutylene copolymer group, polyisobutylene group, polyester group, etc., is also applied to the glue margin 2*i*'. The emulsion-type adhesive is also applied to the back surface of the glue margin 2*h*'.

Then, as shown in FIG. 3, the tubular film 3' is adhered to the panels 2*a*', 2*d*', 2*g*' of the carton blank 2' by means of an adhesive. The tubular film 3' is so arranged that the back-sealed portion 16 is in abutment on the side panel 2*c* and is opposed to the pouring spout 5 when the carton blank 2' is set up. Then, the side panels 2*b*', 2*c*' are folded on the tubular film 3' and barrel-sealed. The panels 2*b*', 2*c*' and the glue margin are adhered to the tubular film 3', and the panels 2*b*' are adhered. Thus flat bag-in-carton before set up is formed.

Then, the flat bag-in-carton 1 is fed to the setting-up step portion and the loading step portion, and is set up there into a rectangular parallelepiped and completed. Then, a pouring spout attached portion 15 (FIG. 3) of the carton blank 27 is punched, and the pouring spout 5 is attached. Then, the upper end of the tubular film 3' is seal-closed.

Figure 5A:
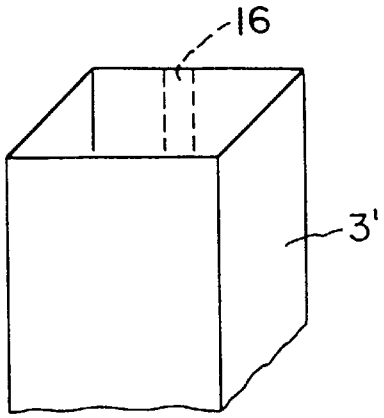
FIG. 5A is a view of the tubular film in its sealed state.
Figure 5B:
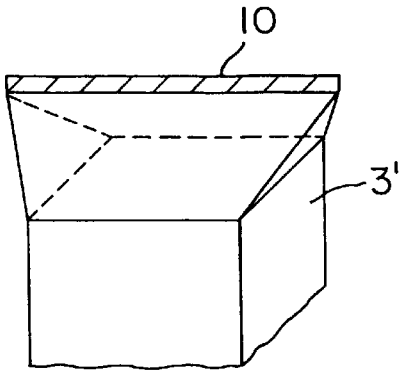
FIG. 5B is a view of the tubular film in its sealed state.
Figure 5C:
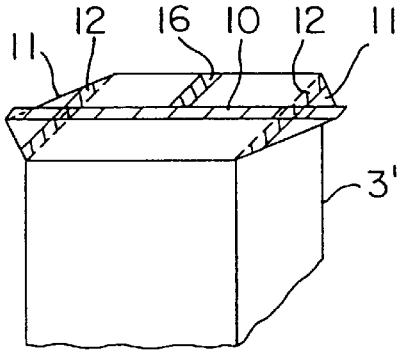
FIG. 5C is a view of the tubular film in its sealed state.
Figure 5D:
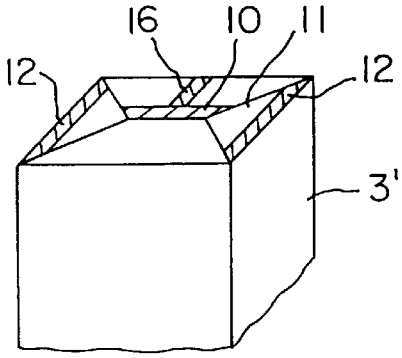
FIG. 5D is a view of the tubular film in its sealed state.

This seal closing operation is conducted as shown in FIGS. 5A to 5D (in FIGS. 5A to 5D the carton is shown simplified for easy understanding). That is, as shown in FIG. 5A, the end of the tubular film 3' opened in a rectangular parallelepiped is closed as shown in FIG. 5B, and the end is sealed horizontally to form a first seal 10. Then, the first seal 10 is pressed flat as shown in FIG. 5*C* to form triangular flaps 11 on both sides. The bottom sides of the triangular flaps 11 are sealed to form second seals 12, and the triangular flaps 11 are folded inward as shown in FIG. 5D, whereby the tubular film 3' is set up with the end of the tubular film 3' are sealed. Because of the second seals 12 on the bottom sides of the triangular flaps 11, the inner bag 3 is free from its content entering the triangular flaps 11 and trapped there with a result that a large amount of the content resides. The second seals 12 have reinforcing effect, and also functions to retain the inner bag 3 substantially rectangular parallelepiped. It is possible to deform entirely the inner bag 3 in good shape when a content is drawn out.

After the tubular film 3' is set up with the upper end of the tubular film 3' sealed, the top of the carton blank 2' is set up.

Then, the lower end of the tubular film 3' is sealed in the same way as the upper end thereof, and then the bottom of the carton blank 2' is set up. And the bag-in-carton 1 accommodating the inner bag 3 in the carton 2 is set up. This process can be conducted by the conventional bag-in-carton forming technique, and the forming equipments, etc. are not explained. Finally a content 4, such as ink or others, is loaded in the bag-in-carton 1, and the bag-in-carton 1 has the state shown in FIG. 1A.

In using the bag-in-carton filled with a content 4, as shown in FIGS. 1A and 1B, the bag-in-carton is set on a machine, such as a printing machine or others, with the pouring spout directed downward, and the pouring spout is connected to a connector (not shown) of drawing means belonging to the machine. The content 4 is drawn and discharged through the pouring spout 5. At this time, the inner bag 3 starts being released from the inner-bag adhering regions 9 on the side panel 2*c*, which are spot-adhesions, and then from the pair of opposed side panels 2*b*, 2*d*. As the content 4 is drawn, the released parts of the inner bag 2 is deformed as shown by the two-dot lines 21*a*, 21*b* in FIG. 1B and is displaced to the pouring spout 5, whereby the content 4 can be discharged in a stably constant amount without letting air into the inner bag 3. Finally the released part of the inner bag 3 is withdrawn into the unreleasable part thereof, which is fixed to the inside surfaces of the carton 2 and are substantially a rest half of the inner bag 3, and almost all the content is discharged.

Next, the adhesive strength of the releasable part 9*a* and the unreleasable part 9*a* will be explained.

Adhesive strengths of the releasable part 9*b* and the unreleasable part 9*a* are substantially as follows.

An adhesive strength (a force (gf) 15 mm-width samples required to be released when subjected to a tensile test at the room temperature) is a strength of the releasable part 9*b* at the start of the release: about 470 gf an adhesive strength of the releasable part 9*b*: about 210 gf .

It is preferable that the unreleasable part 9*a* has a higher adhesive strength than that of the releasable part 9*b*.

As described above, according to the present embodiment, when the content 4 is drawn out through the pouring spout 5, the inner bag 3 starts being released first from the inner-bag adhering regions 9, to which the inner bag 3 is spot adhered, and then from the inside surfaces of the one pair of the side panels 2*b*, 2*d*, and is gradually deformed and displaced to the pouring spout 5. Then, the released part of the inner bag 3 is withdrawn into the unreleasable part thereof, whereby substantially all the content 4 can be drawn out through the pouring spout 5.

The inner bag 3 is gradually released from the inside surfaces of the carton 2 as the content 4 is decreased, whereby the inner bag 3 is kept from being excessively released to adversely contact tightly the unreleasable part thereof, confining the content 4.

The pouring spout 5 is located substantially at the center of the inclined panel 2*g*. The back sealed portion 16 on the inner bag 3 is located at a position where the portion 16 abuts on the side panel 2*c*, and is opposed to the pouring spout 5, i.e., is located substantially at the center of the side panel 2*c*. This arrangement enables the content 4 of the inner bag 3 to be driven to the pouring spout without failure when the inner bag 3 is deformed, displaced to the pouring spout 5 as the content 4 is drawn out.

That is, the back sealed portion 16 of the inner bag 3, which is harder than the rest part of the inner bag 3, tends to hinder the deformation when the inner bag 3 is deformed. Accordingly in a case where the back sealed portion 16 abuts on, e.g., the side panel 2*b*, which is adjacent to the inclined panel 2*g* (the pouring spout attached panel), the back sealed portion 16 hinders the deformation of the inner bag 3 as a result the inner bag 3 may be deformed horizontally unsymmetrically with respect to the pouring spout 5.

According to the present invention, because the back sealed portion 16 is located opposed to the pouring spout 5, the inner bag 3 can be deformed horizontally symmetrically with respect to the pouring spout 5 as the center, whereby the content 4 of the inner bag 3 can be smoothly sent out to the pouring spout without unsymmetrical deformation.

Next, another embodiment of the present invention will be explained with reference to FIG. 6. The embodiment shown in FIG. 6 is substantially the same as the embodiment shown in FIGS. 1A to 5D except that the inner-bag adhering regions have different shapes from those of the embodiment shown in FIGS. 1A to 5D.

Figure 6:
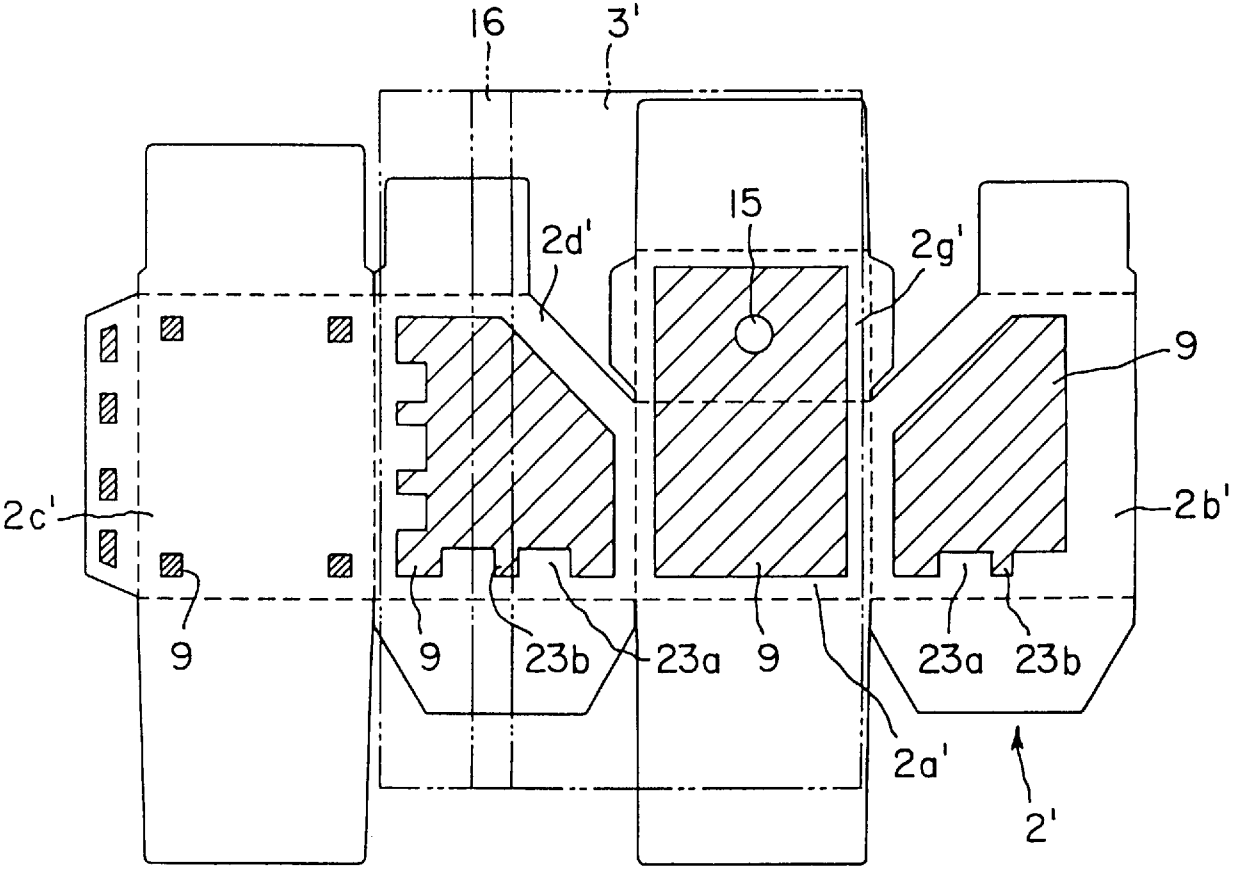
FIG. 6 is the same view of bag-in-carton according to another embodiment of the present invention as FIG. 3.

As shown in FIG. 6, on the panels 2*b*', 2*d*' (which are to be a pair of side panels 2*b*, 2*d*) of a carton blank 2', inner-bag adhering regions 9 have concavities 23*a* and convexities 23*b* on the boundaries, and the boundaries of the inner-bag adhering regions 9 on the panels 2*b*', 2*d*' are concave and convex.

It is preferred that the convexities and concavities 23*a*, 23*b* of the inner-bag adhering regions 9 on the panels 2*b*', 2*d*' are formed in parts which are remotest from a pouring spout 5. When the content 4 is drawn out through the pouring spout 5, the inner bag 3 starts being released from the parts of the pair of side panels 2*b*, 2*d* which are remotest from the pouring spout 6, and the concavities and convexities 23*a*, 23*b* formed in the remotest parts of the inner-bag adhering regions 9 from the pouring spout 5 enables the inner bag 3 to smoothly start the release.

In the above-described embodiments, the pouring spout 5 has the cylindrical portion 5*a* extended in the inner bag 3, but the pouring spout 5 is not limited to this structure. The pouring spout 5 may be a usual one without the cylindrical portion 5*a*. It is possible that a suitable passage member (e.g., a rod-shaped member or others of H-shaped section) which can ensure a passage for a content to pass through when the releasable part of the inner bag 3 is withdrawn into the unreleasable part thereof is provided in the bottom of the inner bag 3.

In taking out the content 4, the case that the bag-in-carton 1 is set on a machine with the pouring spout 5 faced downward has been explained, but the state is not essential. Depending on machines, the bag-in-carton 1 may be set suitably with the pouring spout 5 faced upward or sidewise. By setting the bag-in-carton 1 on a machine with the pouring spout 5 faced upward, run of the content from the pouring spout 5 can be prevented.

As described above, according to the present invention, the inner bag 3 can be firmly fixed inside the carton 2 before the content 4 is drawn out, and as the content 4 is drawn out, the inner bag 3 can be released from the inside surfaces of the carton to be deformed to the pouring spout 5. The releasable part of the inner bag 3 is withdrawn into the unreleasable part thereof, whereby substantially all the content 4 can be drawn out through the pouring spout 5 without failure. The inner bag 3 is gradually released from the inside surfaces of the carton 2, whereby the releasable part of the inner bag 3 is brought into tight contact with the unreleasable part thereof, confining the content.

A Second Embodiment

A second embodiment of the present invention will be explained with reference to the drawings.

FIGS. 7A to 10D show the second embodiment. The bag-in-carton according to the second embodiment is substantially the same as the bag-in-carton according to the first embodiment shown in FIGS. 1A to 3, and the same members are represented by the same reference numerals to omit their detailed description.

Then, a method for forming the bag-in-carton according to the second embodiment will be explained with reference to FIGS. 3, 4 and FIGS. 7A to 10D. First, as shown in FIG. 3, a cardboard is punched into a required shape to prepare a carton blank 2' to be set up into a carton 2. Inner-bag adhering regions 9 are provided on the inside surfaces of panels 2*a'*, 2*b'*, 2*c'*, 2*d'*, 2*g'* of the carton blank 2' (which are to be side panels 2*a*, 2*b*, 2*c*, 2*d* and the inclined panel 2*g* of the carton 2). While the carton blank 2' is being formed, as shown in FIG. 4, a sheet film is folded into a tubular shape and back-sealed at end portions to form a back-sealed portion 16. The folded film is cut into a tubular film 3' of a required length (whose top and bottom ends will be sealed in a later step into the inner bag).

Then, an adhesive, e.g., an emulsion-type adhesive, as of vinyl acetate group, acryl copolymer group, vinyl acetate-acryl copolymer group, modified ester acrylate copolymer group, etc., is applied to the inner-bag adhering regions 9 which are formed on the substantially entire inside surfaces of the panels 2*a'*, 2*b'*, 2*d'* and 2*g'* of the carton blank 2'. The adhesive is applied to the inner-bag adhering regions 9 formed partially on the side panel 2*c'* and a glue margin 2*h'* of the carton blank 2'. A glue margin 2*i'* of the carton blank 2' is folded inside when the carton blank 2' is set up, and a hot-melt adhesive, as of ethylene-vinyl acetate copolymer group, polyvinyl acetate group, polyamide group, polyethylene group, styrene-butadiene copolymer group, styrene-isobutylene copolymer group, polyisobutylene group, polyester group, etc., is also applied to the glue margin 2*h'*. The emulsion-type adhesive is also applied to the back surface of the glue margin 2*h'*.

Then, as shown in FIG. 3, the tubular film 3' is adhered to the panels 2*a'*, 2*d'*, 2*g'* of the carton blank 2'0 by means of an adhesive. The tubular film 3' is so arranged that the back-sealed portion 16 is in abutment on the side panel 2*c* and is opposed to the pouring spout 5 when the carton blank 2' is set up. Then, the side panels 2*b'*, 2*c'* are folded on the tubular film 3' and body-sealed. The panels 2*b'*, 2*c'* and the glue margin are adhered to the tubular film 3', and the panels 2*b'* are adhered. Thus flat bag-in-carton before set up is formed. Then, the flat bag-in-carton 1 is sent to the setting up and charging step portion to be set up and charged with a content. The bag-in-carton setting up step will be explained with reference to FIGS. 7A to 10D.

Figure 7D:
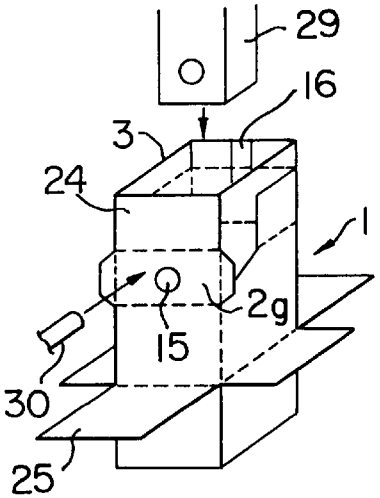
FIG. 7D is a view of the bag-in-carton according to the second embodiment set up in a forming step of the bag-in-carton.
Figure 7C:
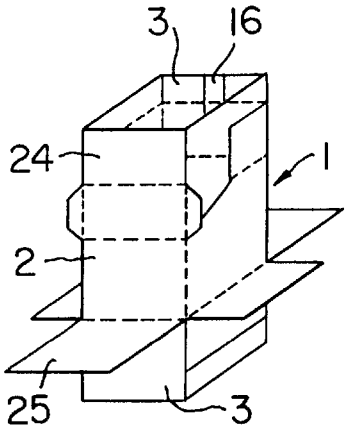
FIG. 7C is a view of the bag-in-carton according to the second embodiment set up in a forming step of the bag-in-carton.
Figure 7B:
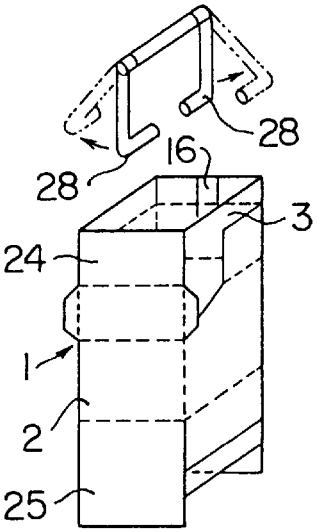
FIG. 7B is a view of the bag-in-carton according to the second embodiment set up in a forming step of the bag-in-carton.
Figure 7A:
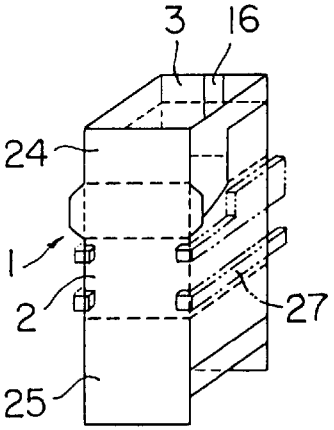
FIG. 7A is a view of the bag-in-carton according to a second embodiment set up in a forming step of the bag-in-carton.

First as shown in FIG. 7A, the bag-in-carton 1 is set up into a rectangular parallelepiped one, supported by a support 27. At this time, openings are formed on both sides of the bag-in-carton 1 (both the upper and the lower sides), and openings are formed in both sides of the inner bag 3. In FIG. 7A, the carton 2 has a plurality of side panels 24 on one side opening and a plurality of side panels 25 on the other side opening.

Then, as shown in FIG. 7B, a pair of arms 28 is lowered through the upper opening (one side opening) of the carton 2. Then, the pair of arms 28 is advanced into the inner bag 3 to expand the inner bag 3. Next, the other side panels 25 are expanded by arms not shown (FIG. 7C).

Next, as shown in FIG. 7D, a female die 29 is lowered through the one side opening of the carton 2 and is advanced into the inner bag 3. Then, a male die 30 is brought near the female die 29, and a pouring spout attached portion 15 (see FIG. 3) is punched between the female die 29 and the male die 30 in an inclined panel 2g of the carton 2.

Figure 8D:
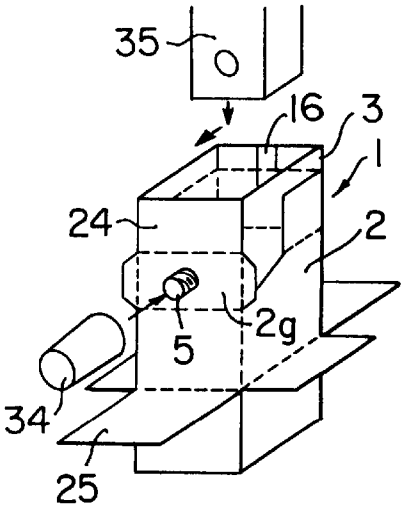
FIG. 8D is a view of the bag-in-carton according to the second embodiment in a forming step of the bag-in-carton in which the pouring spout is attached.
Figure 8C:
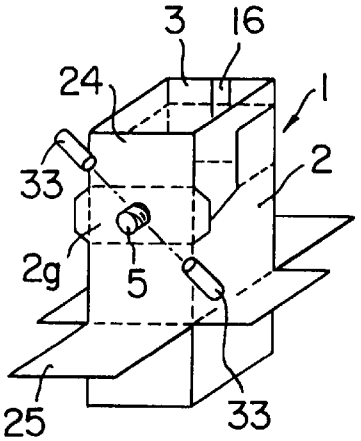
FIG. 8C is a view of the bag-in-carton according to the second embodiment in a forming step of the bag-in-carton in which the pouring spout is attached.
Figure 8B:
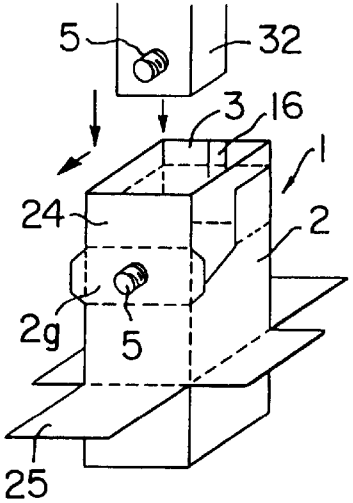
FIG. 8B is a view of the bag-in-carton according to the second embodiment in a forming step of the bag-in-carton in which the pouring spout is attached.
Figure 8A:
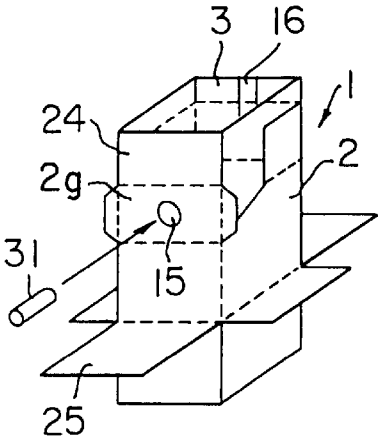
FIG. 8A is a view of the bag-in-carton according to the second embodiment in a forming step of the bag-in-carton in which the pouring spout is attached.

Then, as shown in FIG. 8A, photoelectric tube 31 is brought near the punched pouring spout portion 15 to detect whether or not the pouring spout portion 15 has been punched. Next, as shown in FIG. 8B, a pouring spout holding unit 32 holding a pouring spout 5 is lowered into the inner bag 3 through the one side opening and is further moved to the pouring spout attached portion 15 to mount the pouring spout 5.

Next, as shown in FIG. 8C, it is detected by the photoelectric tube 33 whether or not the pouring spout 5 has been attached. Next, as shown in FIG. 8D, a supersonic wave oscillator 34 is brought near to the pouring spout 5. Simultaneously therewith a supersonic wave receiver 35 is lowered into the inner bag 3 through the one side opening of the carton 2. In this state, supersonic waves are outputted by the supersonic wave oscillator 34 to supersonic wave-seal the pouring spout 5 to the inside surface of the inner bag 3 to be secured o the carton 2.

Figure 9D:
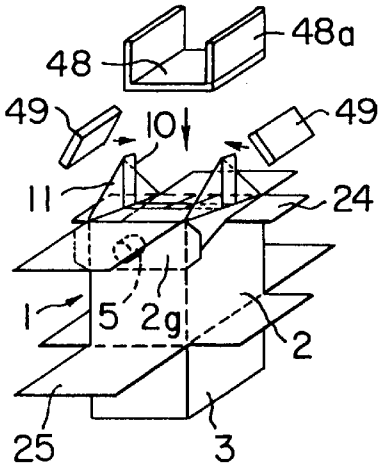
FIG. 9D is a view of the bag-in-carton according to the second embodiment in a forming step of the bag-in-carton in which one seal-closed end is formed.
Figure 9C:
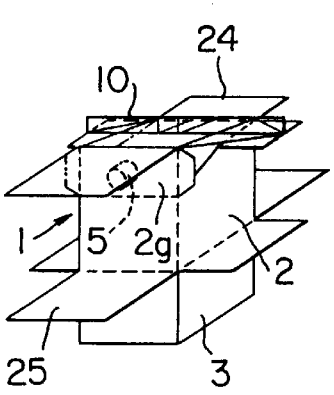
FIG. 9C is a view of the bag-in-carton according to the second embodiment in a forming step of the bag-in-carton in which one seal-closed end is formed.
Figure 9B:
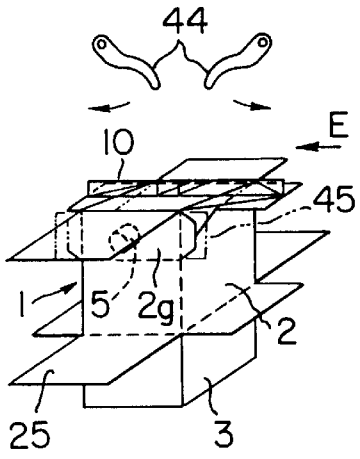
FIG. 9B is a view of the bag-in-carton according to the second embodiment in a forming step of the bag-in-carton in which one seal-closed end is formed.
Figure 9A:
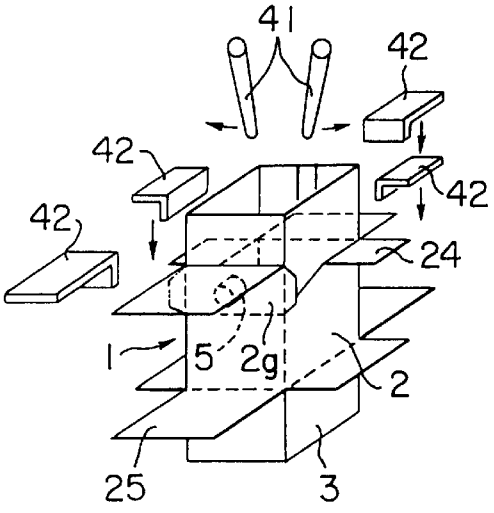
FIG. 9A is a view of the bag-in-carton according to the second embodiment in a forming step of the bag-in-carton in which one seal-closed end is formed.

Then, as shown in FIG. 9A, a pair of arms 41 is lowered through one side opening of the carton 2 and is advanced into the inner bag 3 to expand the inner bag 3. Simultaneously therewith, a pawl unit 42 is brought near the carton 2 to expand the respective panels 24 on one side of the carton 2.

Figure 9E:
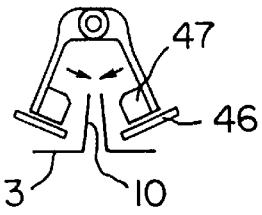
FIG. 9E is a view of the bag-in-carton according to the second embodiment in a forming step of the bag-in-carton in which one seal-closed end is formed.

Then, as shown in FIG. 9B, a pair of seal arms 44 is lowered through one side opening of the carton 2 and is advanced into the inner bag 3 to expand one side opening thereof. Simultaneously therewith, a pair of press levers 46 and a pair of seal bars 47 as shown in FIG. 9E are brought near one end opening of the inner bag 3, and one end opening of the inner bag 3 expanded by the pair of seal arms 44 is pressed first by the pair of press bars 46. Next, the pair of seal bars 47 seal one end opening of the inner bag 3. A first sealed portion 10 is formed in one end opening of the inner bag 3. FIG. 9E shows the inner bag as viewed in the direction of the arrow E in FIG. 9B.

Next,, as shown in FIG. 9C, the first sealed portion 10 formed in one end opening of the inner bag 3 is cooled by a cooling bar (not shown). Then, as shown in FIG. 9D, a holding plate 48 having a pair of side plates is disposed on the upper surface of the first sealed portion 10.

Then, a pair of presser plates 49, 49 are pressed against the pair of side plates to press a pair of triangular flaps formed on one side of the inner bag 3. Air in the triangular flaps 11 is thus exhausted.

Figure 10D:
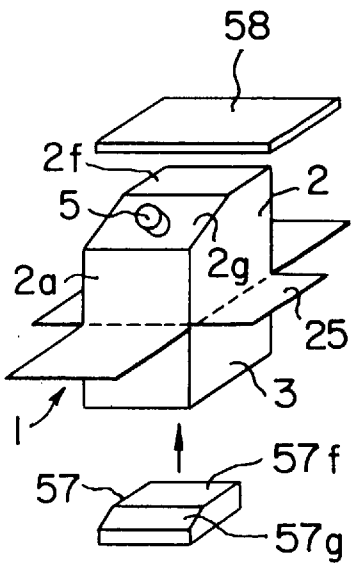
FIG. 10D is a view of the bag-in-carton according to the second embodiment in a forming step of the bag-in-carton in which one tight-closed end is formed.
Figure 10C:
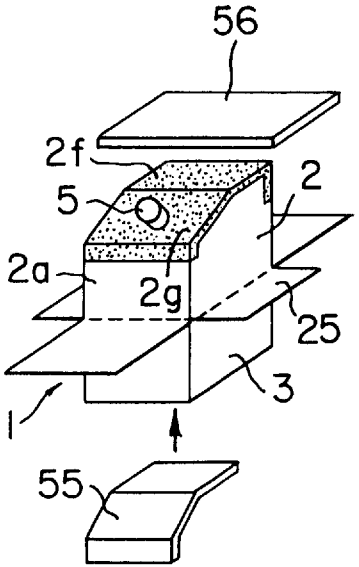
FIG. 10C is a view of the bag-in-carton according to the second embodiment in a forming step of the bag-in-carton in which one tight-closed end is formed.
Figure 10B:
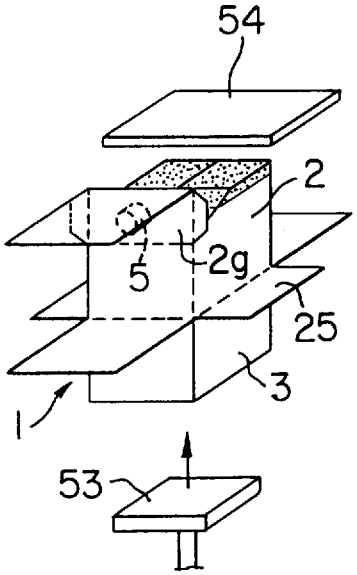
FIG. 10B is a view of the bag-in-carton according to the second embodiment in a forming step of the bag-in-carton in which one tight-closed end is formed.
Figure 10A:
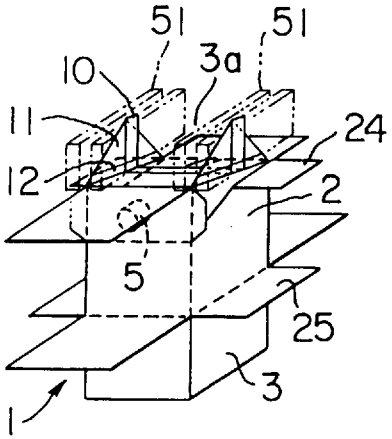
FIG. 10A is a view of the bag-in-carton according to the second embodiment in a forming step of the bag-in-carton in which one tight-closed end is formed.

Next, as shown in FIG. 10A, a pair of seal bars 51 are brought near the triangular flaps 11, and then bottoms of the triangular flaps 11 are sealed by the seal bars 51 to form second sealed portions 12 which are perpendicular to the first sealed portions 10. Thus, one side seal-closed portion 3*a* of the inner bag 3 is formed at one end of the inner bag 3.

Next, as shown in FIG. 10B, the pair of triangular flaps 11 and the respective panels 24 on one side of the inner bag 3 are sequentially folded, and the respective panels 24 are adhered and the shape thereof is formed between the presser plate 54 disposed above the carton 2 and a forming carrier 53 advanced into the inner bag 3 through the lower opening (the other end opening).

Then, as shown in FIG. 10C, all the panels 24 on one end are folded, and one end of the carton 2 is adhered and the shape thereof is formed between a presser plate 56 disposed above the carton 26 and a forcing carrier 55 advanced into the carton 2 through the other end opening. The one end of the carton 2 is thus tight closed to form one side closed portion. In this case, the one side closed portion of the carton 2 has a top panel 2*f*, and an inclined panel 2*g* which is inclined to the top panel 2*f* and having the pouring spout 5 attached to.

Next, as shown in FIG. 10D, a presser plate 58 is disposed above the one side closed portion of the carton 2. On the other hand, a forming jig 57 having a top panel presser surface 57*f* corresponding to the top panel 2*f*, and an inclined panel presser surface 57*f* corresponding to the inclined panel 2*g* is advanced into the inner bag 3 sequentially through the other end opening of the carton 2 and then through the other end opening of the inner bag 3. In this state, the forming jig 57 presses the one side seal-closed end 3*a* of the inner bag 3 closed by the first and the second sealed portions 10, 12 against the one side closed portion of the carton 2. A pressing force of the forming jig 57 at this time is born by the presser plate 58.

By thus pressing the one side seal-closed portion 3*a* of the inner bag 3 against the one side seal-closed portion of the carton 2 by the forming jig 57, the one side seal-closed portion 3*a* of the inner bag 3 can formed in a uniform, constantly stable shape in accordance with a shape of the one side closed portion (corresponding to the top panel 2*f* and the inclined panel 2*g*).

Generally only sealing one end of the flexible inner bag 3 and accommodating the one side seal-closed portion 3*a* of the inner bag 3 in the carton 2 adversely permits the one seal-closed portion 3*a* to take various shapes with a result that the inner bag 3 have various capacities.

Unless the inner 3 bag is accommodated in a constantly stable shape, after a content of the inner bag 3 is discharged, the inner bag 3 has much residue of the content. As a result, the inner bag 3 adversely has various volumes.

In the present invention, the one side seal-closed portion 3*a* of the inner bag 3 is formed by the forming jig 57 in accordance with a shape of the one side closed portion 2*f*, 2*g* of the carton 2, whereby the one side seal-closed portion 3*a* of the inner bag 3 can be formed with good precision, and accordingly the inner bag 3 can have a constant volume. On the other hand, the inner bag 3 is accommodated in a regular, constantly stable shape, whereby the inner bag can have less residual content. Accordingly a certain amount of content can be held in the inner bag with good precision. Furthermore, the pouring spout 5 is attached to the inclined panel 2*g* of the carton 2, and the part of the one side seal-closed portion 3*a* of the inner bag 3 corresponding to the inclined panel 2*g* of the carton 2 can be formed in a uniform, constantly stable shape in accordance with a shape of the inclined panel 2*g* by the inclined presser plate 57*g* of the forming jig 57. Next, the other end opening of the inner bag 3 is sealed in the same way, and the other side seal-closed portion (having the same structure as the one side seal-closed portion 3*a*) is formed, and then the other end of the carton 2 is tight-closed to form the other side closed portion 2*e*. The bag-in-carton 1 comprising the carton 2 accommodating the inner bag therein is thus set up.

These steps can be carried out by the conventional bag-in-carton forming technique, and the detailed description of the forming equipment is omitted. Finally a content, the bag-in-carton 1 is charged with a content, such as ink, and has a state shown in FIG. 1A.

In using the bag-in-carton filled with a content 4, as shown in FIGS. 1A and B, the bag-in-carton is set on a machine, such as a printing machine or others, with the pouring spout directed downward, and the pouring spout is connected to a connector (not shown) of drawing means belonging to the machine. The content 4 is drawn and discharged through the pouring spout 5. At this time, the inner bag 3 starts being released from the inner-bag adhering regions 9 on the side panel 2*c*, which are spot-adhesions, and then from the pair of opposed side panels 2*b*, 2*d*. As the content 4 is drawn, the released parts of the inner bag 2 is deformed as shown by the two-dot lines 21*a*, 21*b* in FIG. 1B and is displaced to the pouring spout 5, whereby the content 4 can be discharged without letting air into the inner bag 3. Finally the released part of the inner bag 3 is withdrawn into the unreleasable part thereof, which is fixed to the inside surfaces of the carton 2 and are substantially a rest half of the inner bag 3, and almost all the content is discharged.

Next, the adhesive strength of the releasable part 9*a* and the unreleasable part 9*a* will be explained.

Adhesive strengths of the releasable part 9*b* and the unreleasable part 9*a* are substantially as follows.

An adhesive strength (a force (gf) 15 mm-width samples required to be released when subjected to a tensile test at the room temperature) is

- a strength of the releasable part 9*b* at the start of the release: about 470 gf
- an adhesive strength of the releasable part 9*b* about: 210 gf It is preferable that the unreleasable part 9*a* has a higher adhesive strength than that of the releasable part 9*b*.

As described above, according to the present embodiment, the one side seal-closed portion 3*a* of the inner bag 3 is formed by means of the forming jig 57 having the top panel presser surface 57*f* and the inclined panel presser surface 57*g* in accordance with a shape of the one side closed portion defined by the inclined panel 2*g* and the top panel 2*f*, whereby the one side seal-closed portion 3*a* of the inner bag 3 can be formed with high precision, and accordingly the inner bag 3 can have a constant volume. Because of the second sealed portion 12 provided on the proximal ends of the triangular flaps 11, which are normal thereto, the content is prevented from being confined in the triangular flaps 11, without a result that more of the content resides. The second sealed-portion 12 has a function of reinforcement, whereby the inner bag 3 can be retained substantially rectangular parallelepiped. When a content is drawn out, the inner bag can be generally deformed in good shape.

In the above-described embodiments, the pouring spout 5 has the cylindrical portion 5*a* extended in the inner bag 3, but the pouring spout 5 is not limited to this structure. The pouring spout 5 may be a usual one without the cylindrical portion 5*a*. It is possible that a suitable passage member (e.g., a rod-shaped member or others of H-shaped section) which can ensure a passage for a content to pass through when the releasable part of the inner bag 3 is withdrawn into the unreleasable part thereof is provided in the bottom of the inner bag 3.

In taking out the content 4, the case that the bag-in-carton 1 is set on a machine with the pouring spout 5 faced downward has been explained, but the state is not essential.

Depending on machines, the bag-in-carton 1 may be set suitably with the pouring spout 5 faced upward or sidewise. By setting the bag-in-carton 1 on a machine with the pouring spout 5 faced upward, run of the content from the pouring spout 5 can be prevented.

Furthermore, the inner bag 3 can be accommodated in a constantly stable shape, whereby less of the content resides after discharged.

According to the present invention, the one side seal-closed portion 3*a* of the inner bag 3 can be formed by the forming jig 57 in accordance with the one side closed portion defined by the top panel 2*f* and the inclined panel 2*g* of the carton 2, whereby the inner bag 3 can have a substantially constant volume with high precision.

The inner bag 3 can be accommodated constantly stable. When the content 4 is drawn out, the inner bag 3 can be generally deformed in good shape, and less of the content resides.

A Third Embodiment

Next, a third embodiment of the present invention will be explained with reference to the drawings.

Figure 11A:
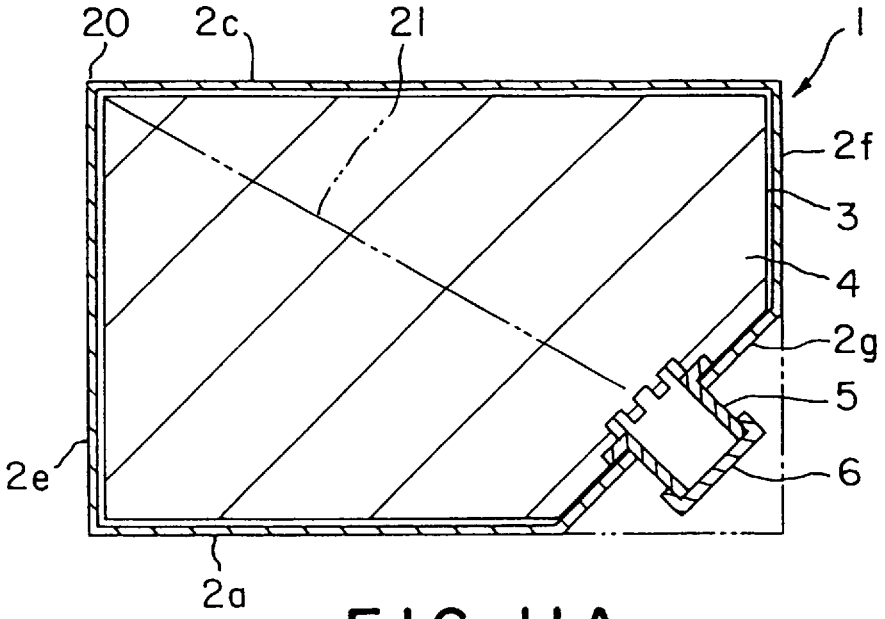
FIG. 11A is a side sectional view of the bag-in-carton according to a third embodiment of the present invention in its state where the bag-in-carton is filled with a content.
Figure 11B:
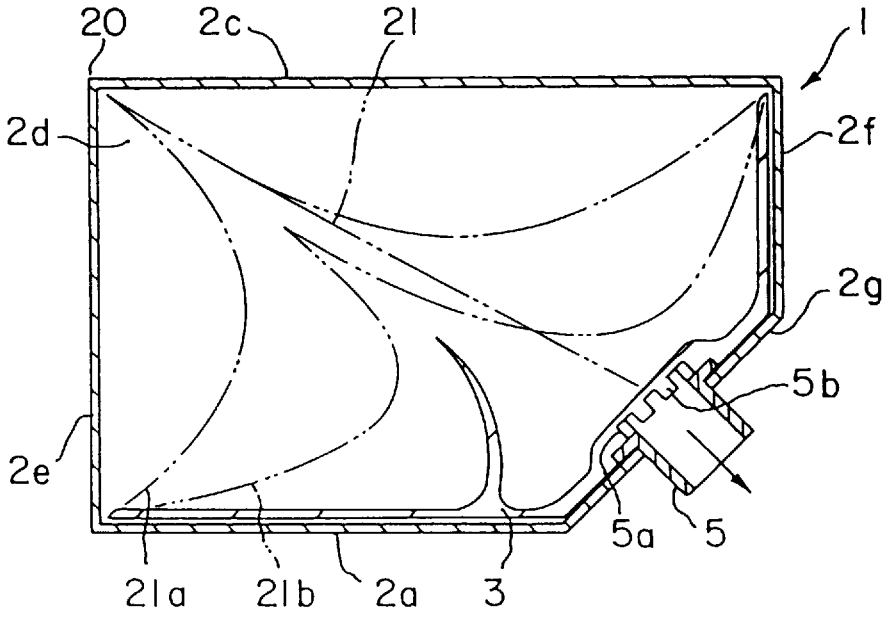
FIG. 11B is a side sectional view of the bag-in-carton according to the third embodiment of the present invention in its state where the content is drawn out.
Figure 12:
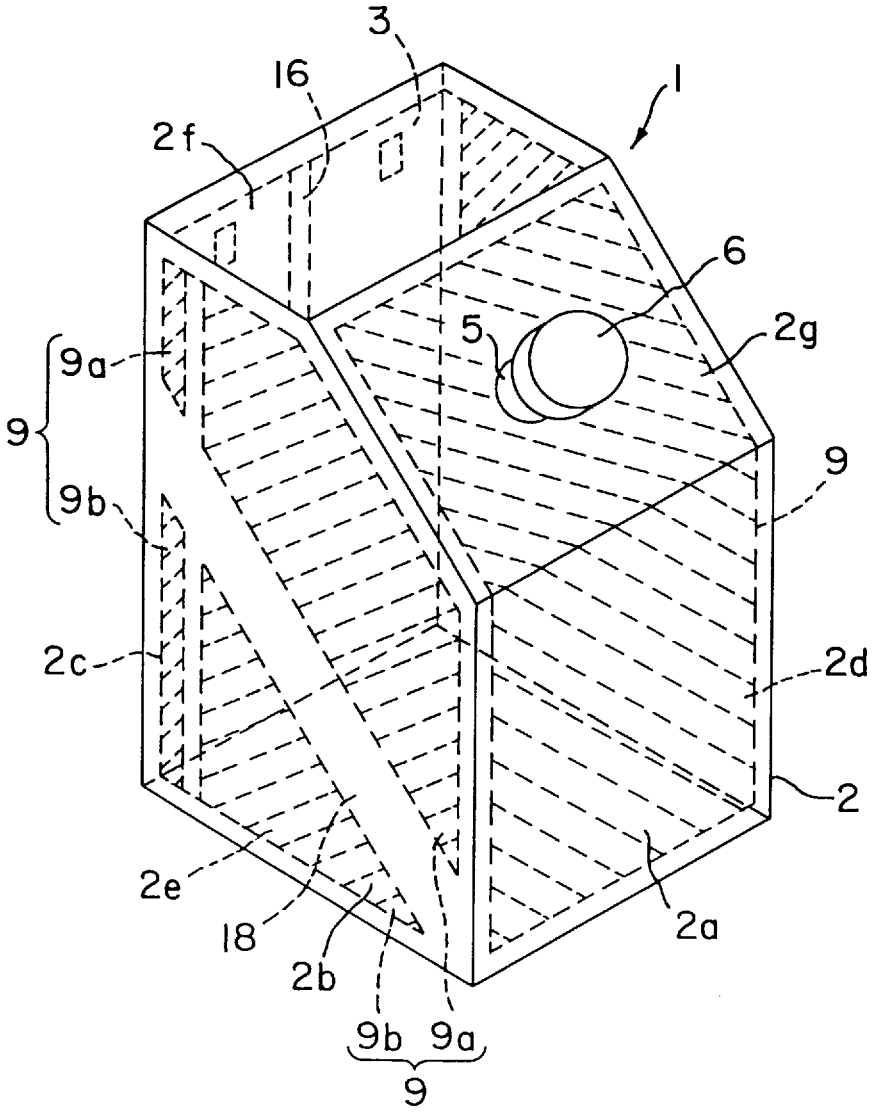
FIG. 12 is a diagrammatic perspective view of the bag-in-carton.

FIGS. 11A to 13 show the bag-in-carton according to the third embodiment of the present invention. FIG. 11 shows the bag-in-carton in a state where the bag-in-carton is filled with a content, and FIG. 11B shows the bag-in-carton in a state where the content is drawn out. FIG. 12 is a diagrammatic perspective view of the bag-in-carton. In FIGS. 11A, 11B and 12, the bag-in-carton 1 comprises a substantially rectangular parallelepiped box-shaped carton 2 which provides an outer container, and a flexible inner bag 3 accommodated in the outer container. The inner bag 3 holds a liquid content 4, such as ink or others. The carton 2 has an inclined panel between two adjacent panels of the rectangular parallelepiped, and has four flat side panels 2*a*, 2*b*, 2*c*, 2*d*, a top and a bottom panels 2*e*, 2*f*, and the inclined panels 2*g* formed between the side panels 2*f*, 2*a*.

A pouring spout 5 is attached to the inclined panel 2*g* of the carton 2 in communication with the inner bag 3, and the pouring spout 5 is closed with a cap 6. The pouring spout 5 has a tubular portion 5*a* which is extended into the inner bag through the inclined panel 2*g* and the inner bag 3, and has grooved passages 5*b* for passing the liquid formed in the end part of the tubular portion 5*a* on the side of the inner bag 3. Because of the passages 5*b*, even when, for example, the end of the tubular portion 5*a* in the inner bag 3 is blocked by the inner bag 3, the content 4 can be drawn out into the pouring spout 5 through the passages 5*b*. A projection height of the pouring spout 5 beyond the carton 2 is so set that the cap 6 put on the pouring spout 5 is within a region defined by an extension of the side panel 2*a* and an extension of the top panel 2*f*. This arrangement permits a number of the bag-in-cartons to be laid one on another and side by side in rows and columns.

The inner bag 3 is adhered fixedly to parts of the inside surfaces of the carton 2.

That is, as shown in FIGS. 11A to 13, the inner bag 3 is adhered to the substantially entire inside surfaces of the inclined panel (pouring spout attached panel) 2*g*, the pair of the opposed side panels 2*b*, 2*d* which are adjacent to the inclined panel 2*g* and the side panel 2*a* adjacent to the lower edge of the inclined panel 2*g*. The inner bag 3 may be adhered to the substantially entire inside surfaces of the inclined panel 2*g* and the side panel 2*a* at spots by an adhesive.

Figure 13:
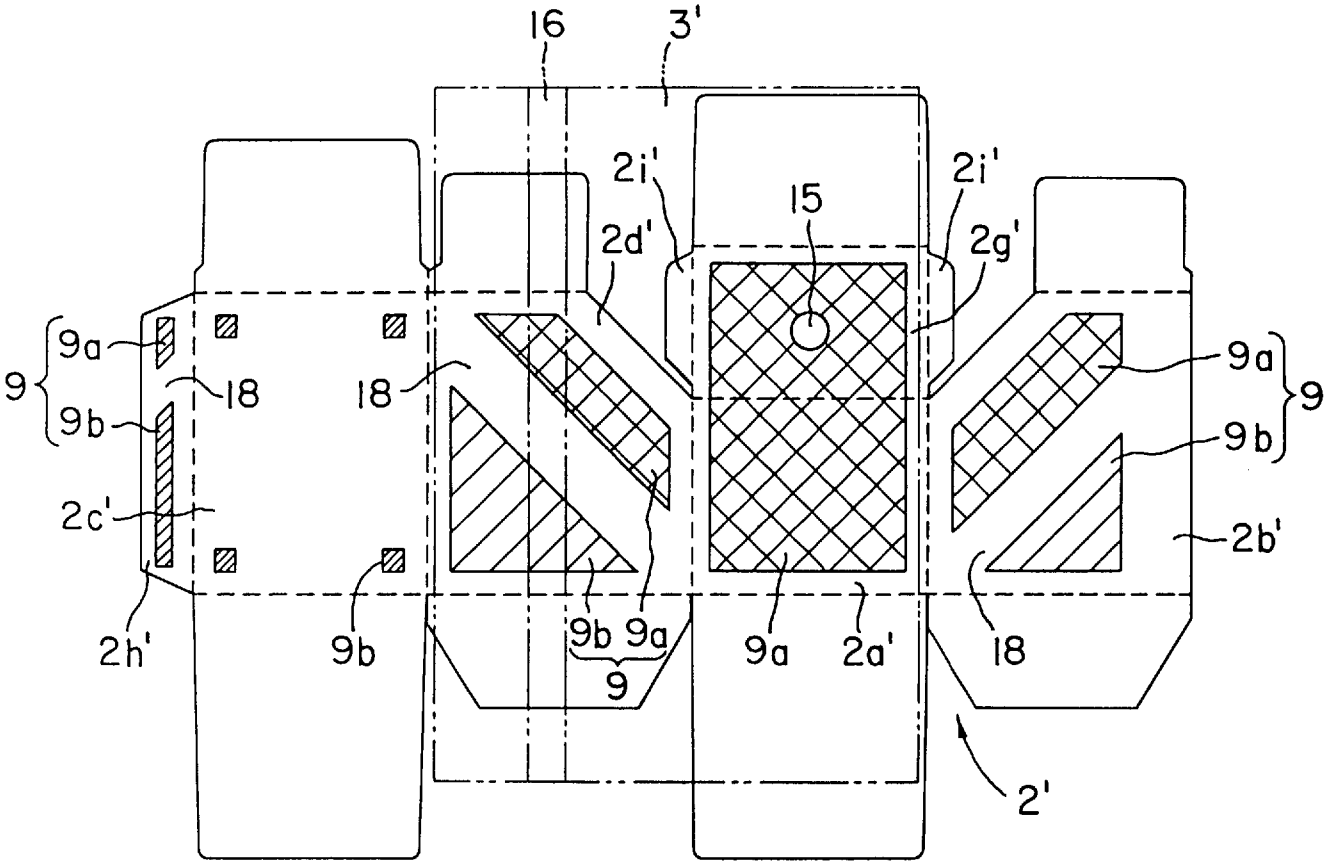
FIG. 13 is a diagrammatic plan view of a carton blank for the bag-in-carton, and a tubular film.

As shown in FIGS. 12 and 13, the inner bag 3 is also adhered to the regions of one pair of the side panels 2*b*, 2*d* opposed to each other and adjacent to the inclined panel 2*g*, which (regions) exclude strips 18. The strips 18 on the pair of the side panels 2*b*, 2*d* are regions formed substantially at the middle of a straight line 21 (see FIGS. 11A and 11B) interconnecting the pouring spout 5 and the remotest end part 20 of the carton 2, which is remotest from the pouring spout 5 and are formed substantially normal to the straight line 21. The strips 18 thus formed on the pair of the side panels 2*b*, 2*d* permit the inner bag 3 to start being released at the side of the remotest end part 20 on the pair of the side panels 2*b*, 2*d* as will be described later, when the inner bag 3 is released from the inside surfaces of the carton 2 and finish the release.

The inner bag 3 is also adhered partially (to the four corners) to the side panel 2*c* of the side panels which are not adjacent to the inclined panel 2*g* but remote from the same. FIG. 12 shows the inner-bag adhering regions 9. FIG. 13 shows a carton blank 2' for forming the carton. In FIGS. 12 and 13, parts of the inner-bag adhering regions 9 on the pair of side panels 2*b*, 2*d*, which are on the upper side of the strips 18 and are nearer to the pouring spout 5 are unreleasable regions 9*a*, and the rest parts are releasable regions 9*b*. The inner-bag adhering region on the side panel 2*c* is a releasable region 9*b*.

As described above, the inner bag 3 is adhered to all the inside surface of the inclined panel 2*g* and substantially all the entire inside surface of the side panel 2*a* below the inclined panel 2*g*, to the inside surfaces of the pair of side panels 2*b*, 2*d* except the strips 18, and partially to the inside surface of the side panel 2*c*, whereby the inner bag 3 can be firmly fixed inside the carton 2. The inner bag 3 is adhered to the carton 2 releasably by an adhesive. Accordingly as the content 4 is decreased, the inner bag 3 can be readily released from the carton 2, withdrawn into itself.

When the content 4 is discharged through the pouring spout 5, the inner bag 3 is gradually deformed and moved to the pouring spout 5. At this time, the inner bag 3 starts being released first from the side panel 2*c*. The spot adhesion of the inner bag 3 to the side panel 2*c* allows the inner bag 3 to be readily released from the side panel 2*c*. The inner-bag adhering region 9 of the inner bag 3 to the inside surface of the side panel 2*c* may be square or rectangular.

Then, a method for forming the bag-in-carton 1 having the above-described structure will be explained. First, a cardboard is punched in a prescribed shape as shown in FIG. 13 to prepare a carton blank 2' to be set up into the carton. The inner-bag adhering regions 9 are formed on the inside surface of the panels 2*a*', 2*b*', 2*c*', 2*d*', 2*g*' of the carton blank 2' (which are to be the side panels 2*a*, 2*b*, 2*c*, 2*d* and the inclined panel 2*g*). While the carton blank 2' is being formed, as shown in FIG. 4, a sheet film is folded into a tubular shape and back-sealed at end portions to form a back-sealed portion 16. The folded film is cut into a tubular film 3' of a required length (whose top and bottom ends will be sealed in a later step into the inner bags).

Then, an adhesive, e.g., an emulsion-type adhesive, as of vinyl acetate group, acryl copolymer group, vinyl acetate-acryl copolymer group, modified ester acrylate copolymer group, etc., is applied to the inner-bag adhering regions 9 which are formed on the substantially entire inside surfaces of the panels 2*a*', 2*b*', 2*d*' and 2*g*' of the carton blank 2'. The adhesive is applied to the inner-bag adhering regions 9 formed partially on the side panel 2*c*' and a glue margin of the carton blank 2'. The glue margin 2*h*' is a part forming the side panel 2*b* of the carton 2 and has an inner-bag adhering region 9 including the unreleasable region 9*a* and the releasable region 9*b* formed on both sides of the strip 19. The emulsion-type adhesive is also applied to the back surface of the glue margin 2*h*'.

The glue margin 2*i'* of the carton blank 2' is folded inside when the carton blank 2' is set up into the carton 2. A hot-melt adhesive, as of ethylene-vinyl acetate copolymer group, polyvinyl acetate group, polyamide group, polyethylene group, styrene-butadiene copolymer group, styrene-isobutylene copolymer group, polyisobutylene group, polyester group, etc., is also applied to the glue margin 2*i'*.

Then, as shown in FIG. 13, the tubular film 3' is adhered to the panels 2*a'*, 2*d'*, 2*g'* of the carton blank 2' by means of an adhesive. The tubular film 3' is so arranged that the back-sealed portion 16 is in abutment on the side panel 2*c* and is to be opposed to the pouring spout 5 when the carton blank 2' is set up. Then, the side panels 2*b'*, 2*c'* are folded on the tubular film 3' and body-sealed. The panels 2*b'*, 2*c'* and the glue margin 2*h'* are adhered to the tubular film 3', and the panels 2*b'* are adhered. Thus flat bag-in-carton before set up is formed.

Then, the flat bag-in-carton 1 is fed to the setting-up step portion and the loading step portion, and is set up there into a rectangular parallelepiped and completed. Then, a pouring spout attached portion 15 (FIG. 13) of the carton blank 2' is punched, and the pouring spout 5 is attached. Then, the upper end of the tubular film 3' is seal-closed.

After the carton blank is set up with the upper end of the tubular film 3' sealed, the top of the carton blank 2 is set up.

Then, the lower end of the tubular film 3' is sealed in the same way as the upper end thereof, and then the bottom of the carton blank 2' is set up. And the bag-in-carton 1 accommodating the inner bag 3 in the carton 2 is set up. This process can be conducted by the conventional bag-in-carton forming technique, and the forming equipments, etc. are not explained. Finally a content 4, such as ink or others, is loaded in the bag-in-carton 1, and the bag-in-carton 1 has the state shown in FIG. 11A.

In using the bag-in-carton filled with a content 4, as shown in FIGS. 11A and 11B, the bag-in-carton is set on a machine, such as a printing machine or others, with the pouring spout directed downward, and the pouring spout is connected to a connector (not shown) of drawing means belonging to the machine. The content 4 is drawn and discharged through the pouring spout 5. At this time, the inner bag 3 starts being released from the inner-bag adhering regions 9 on the side panel 2*c*, which are spot-adhesions, and then from the pair of opposed side panels 2*b*, 2*d*. As the content 4 is drawn out, the releasable part of the inner bag 2 is deformed as indicated by the two-dot lines 21*a*, 21*b* in FIG. 11B and is moved along the straight line 21 interconnecting the pouring spout 5 and the remotest end part 20, whereby the content 4 can be discharged in a constant discharge amount without letting air in the inner bag 3. Finally the released part of the inner bag 3 is withdrawn into the rest half unreleasable part of the inner bag 3, and substantially all the content is discharged.

At this time, on the pair of side panels 2*b*, 2*d*, the inner bag 3 starts being released on the side of the remotest end part of the carton 2, and the end of the release of the inner bag 3 can be exactly determined by the strips 18 formed substantially crossing the straight line 21 at the substantial middle thereof, whereby the inner gab can be uniformly deformed. Accordingly the content of the inner bag 3 can be supplied stably in a constant amount.

Next, the adhesive strength of the releasable part 9*a* and the unreleasable part 9*a* will be explained.

Adhesive strengths of the reasonable part 9*b* and the unreleasable part 9*a* are substantially as follows.

An adhesive strength (a force (gf) 15 mm-width samples required to be released when subjected to a tensile test at the room temperature) is a strength of the releasable part 9*b* at the start of the release: about 470 gf an adhesive strength of the releasable part 9*b*: about 210 gf.

It is preferable that the unreleasable part 9*a* has a higher adhesive strength than that of the releasable part 9*b*.

As described above, according to the present embodiment, when the content 4 is drawn out through the pouring spout 5, the inner bag 3 starts being released first from the inner-bag adhering regions 9, to which the inner bag 3 is spot adhered, and then from the inside surfaces of the one pair of the side panels 2*b*, 2*d*, and is gradually deformed and displaced to the pouring spout 5. Then, the released part of the inner bag 3 is withdrawn into the unreleasable part thereof, whereby substantially all the content 4 can be drawn out through the pouring spout 5. At this time, on the pair of side panels 2*b*, 2*d*, the release of the inner bag 3 can be stopped at the strips 18, whereby the inner bag 3 can be uniformly deformed, and accordingly the content 4 of the inner bag can be fed in a stably constant amount.

The back sealed portion 16 formed on the inner bag 3 is in abutment on the side panel 2*c* and is opposed to the pouring spout 5. Accordingly as the content 4 is drawn out, the inner bag 3 is deformed and moved to the pouring spout 5, whereby the content 4 of the inner bag 3 is discharged to the pouring spout 4 without failure.

That is, the back sealed portion 16 of the inner bag 3, which is harder than the rest part of the inner bag 3, tends to hinder the deformation when the inner bag 3 is deformed. Accordingly in a case that the back sealed portion 16 abuts on, e.g., the side panel 2*b*, which is adjacent to the inclined panel 2*g* (the pouring spout attached panel), the back sealed portion 16 hinders the deformation of the inner bag 3 with a possible result that the inner bag 3 may be deformed horizontally unsymmetrically with respect to the pouring spout 5.

According to the present invention, because the back sealed portion 16 is located opposed to the pouring spout 5, the inner bag 3 can be deformed horizontally symmetrically with respect to the pouring spout 5 as the center, whereby the content 4 of the inner bag 3 can be smoothly sent out to the pouring spout without unsymmetrical deformation.

In the above-described embodiments, the pouring spout 5 has the cylindrical portion 5*a* extended in the inner bag 3, but the pouring spout 5 is not limited to this structure. The pouring spout 5 may be a usual one without the cylindrical portion 5*a*. It is possible that a suitable passage member (e.g., a rod-shaped member or others of H-shaped section) which can ensure a passage for a content to pass through when the releasable part of the inner bag 3 is withdrawn into the unreleasable part thereof is provided in the bottom of the inner bag 3.

In taking out the content 4, the case that the bag-in-carton 1 is set on a machine with the pouring spout 5 faced downward has been explained, but the state is not essential. Depending on machines, the bag-in-carton 1 may be set suitably with the pouring spout 5 faced upward or sidewise. By setting the bag-in-carton 1 on a machine with the pouring spout 5 faced upward, run of the content from the pouring spout 5 can be prevented.

As described above, according to the present invention, the inner bag 3 can be firmly fixed inside the carton 2 before the content 4 is drawn out, and as the content 4 is drawn out, the inner bag 3 can be released from the inside surfaces of the carton to be deformed to the pouring spout 5. The releasable part of the inner bag 3 is withdrawn into the unreleasable part thereof, whereby substantially all the content 4 can be drawn out through the pouring spout 5 without failure. At this time, ton the pair of side panels 2*b*, 2*d* the release of the inner bag 3 starts on the side of the remotest end part 20 and stops at the strips 18, whereby the end position of the release of the inner bag 3 can be exactly determined, and accordingly the inner bag 3 can be uniformly deformed. As a result, the content 4 of the inner bag 3 can be supplied in a stably constant amount.

A fourth Embodiment

A fourth embodiment of the present invention will be explained with reference to the drawings.

Figure 14:
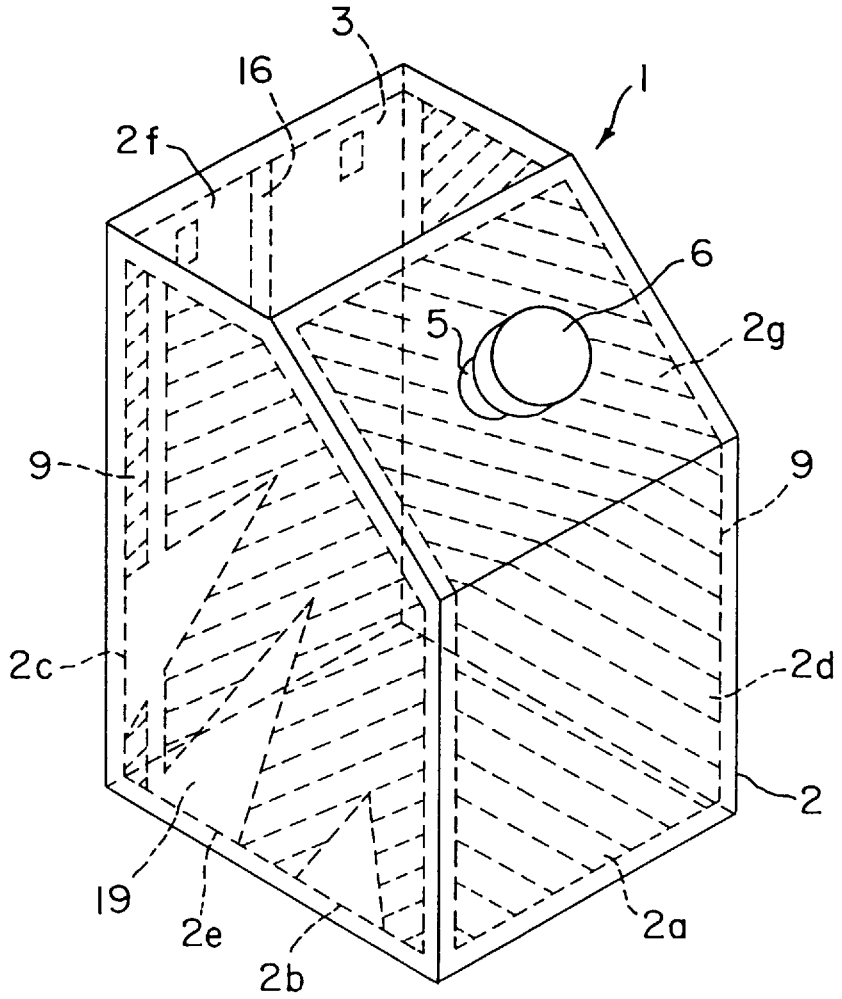
FIG. 14 a diagrammatic perspective view of the bag-in-carton according to a fourth embodiment of the present invention.

FIGS. 14 to 19C are views of the fourth embodiment of the present invention. In FIG. 14, the bag-in-carton 1 comprises a substantially parllelepiped box-shaped carton 2 which provides an outer container, and a flexible inner bag 3 housed inside the carton 2. A content 4, such as ink, is held in the inner bag 3. The carton 2 includes an inclined panel between two panels of the rectangular parallelepiped one, that is, the carton 2 comprises four flat side panels 2*a*, 2*b*, 2*c*, 2*d*, a top and a bottom panels 2*f*, 2*e*, and the inclined panel 2*g* formed between the side panel 2*a* and the top panel 2*f*.

A pouring spout 5 is attached to the inclined pane 2*g* of the carton 2 in communication with the inner bag 3 and is closed by a cap 6. The pouring spout 5 has a tubular portion 5*a* extended in the inner bag 3 through the inclined panel 2*g* and the inner bag 3 (see FIG. 1) and has grooved passages 5*b* for passing the liquid formed in the end part of the tubular portion 5*a* on the side of the inner bag 3. Because of the passages 5*b*, even when, for example, the end of the tubular portion 5*a* in the inner bag 3 is blocked by the inner bag 3, the content 4 can be drawn out into the pouring spout 5 through the passages 5*b*. A projection height of the pouring spout 5 beyond the carton 2 is so set that the cap 6 put on the pouring spout 5 is within a region defined by an extension of the side panel 2*a* and an extension of the top panel 2*f*. This arrangement permits a number of the bag-in-cartons to be laid one on another and side by side in rows and columns.

The inner bag 3 is adhered fixedly to parts of the inside surfaces of the carton 2.

Figure 15:
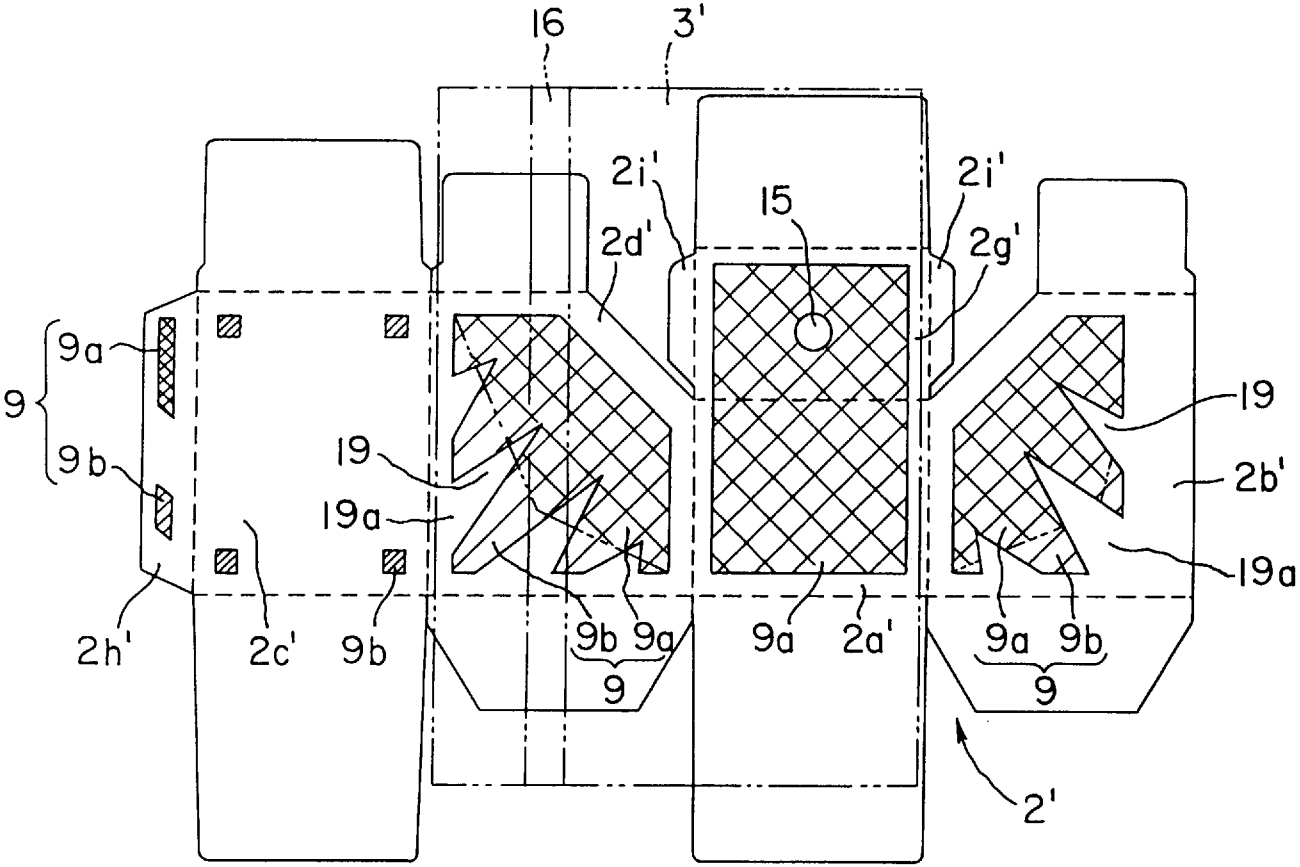
FIG. 15 is a diagrammatic plan view of a carton blank for the bag-in-carton, and a tubular film.

As shown in FIGS. 14 and 15, the inner bag 3 is adhered to substantially all the inside surfaces of the inclined panel (pouring spout attaching panel) 2*g* and the side panel 2*a* adjacent to the lower side of the inclined panel 2*g*. It is possible that an adhesive is spotted on the inside surfaces of the inclined panel 2*g* and the side panel 2*a* to spot-adhere the inner bag 3 to substantially all the inside surfaces of the inclined panel 2*g* and the side panel 2*a*.

As shown in FIGS. 14 and 15, the inner bag 3 is adhered to the inside surfaces of one pair of opposed side panels 2*b*, 2*d* adjacent to the inclined panel 2*g* except a plurality of regions in the shape of recesses 19. The recesses 19 on the pair of side panels 2*b*, 2*d* are extended substantially parallel with a straight line 21 (see FIGS. 11A and 11B) interconnecting the pouring spout 5 and a remote end part 20 of the carton 2 which is remotest from the pouring spout 5.

The plural recesses 19 are located on parts of the pair of side panels 2*b*, 2*d* which are on the side of the remote end part of the carton 2, and the openings 19 are directed to the remote end part 20. The inner bag 3 is adhered to substantially all parts of the pair of side panels 2*b*, 2*d* which are on the side of the pouring spout 5.

The recesses 19 having the openings 19*a* directed to the remote end part 20 are thus provided in the parts of the pair of side panels 2*b*, 2*d* on the side of the remote end part 20, whereby the inner bag can be readily released from the pair of side panels 2*b*, 2*d* first on the side of the remote end part 20 (see FIGS. 11A and 11B) when the inner bag is released from the inside surfaces of the carton as will be described later. That is, the inner bag 3 can more readily released in comparison with the case where the inner-bag adhering regions 9 are formed on the entire inside surfaces of the pair of side panels 2*b*, 2*d*. The inner bag 3 is adhered to the inside surface partially (the four corners) of the side panel 2*c* of the side panels which are not adjacent to but remote from the inclined panel 2*g*. FIG. 14 shows the inner-bag adhering regions 9 of the inner bag 3. FIG. 15 shows a carton blank 2' for forming the carton 2. In FIG. 15, the cross-hatched part of the inner-bag adhering regions 9 are unreleasable regions 9*a*, and the line-hatched regions are releasable region 9*b*.

The inner bag 3 is thus adhered to the substantially entire inside surfaces of the inclined panel 2*g* and the side panel 2*a* adjacent to the lower side of the inclined panel 2*g*, to the inside surfaces of the pair of side panels 2*b*, 2*d* except the recesses 19, and partially to the inside surface of the side panel 2*c*, whereby the inner bag 3 can be firmly fixed in the carton 2. The inner bag 3 is adhered to the carton by means of a releasable adhesive. Accordingly, as the content is discharged, the inner bag 3 is deformed to readily release the inner bag from the carton 2.

The inner bag 3 is spot-adhered to the side panel 2*c* at the releasable regions 9*b*. When the content 4 is discharged through the pouring spout 5, the inner bag 3 is gradually deformed and moved to the pouring spout 5. At this time, the inner bag 3 starts being released first from the side panel 2*c*, which is remote from the pouring spout 5. The spot-adhesion of the inner bag 3 to the side panel 2*c* facilitates the release of the inner bag 3 from the side panel 2*c*. The inner-bag adhering regions 9 on the side panel 2*c* may be square as shown in FIG. 15 or may be rectangular.

Then, a method for forming the bag-in-carton 1 having the above-described structure will be explained. First, a cardboard is punched in a prescribed shape as shown in FIG. 15 to prepare a carton blank 2' to be set up into the carton. The inner-bag adhering regions 9 are formed on the inside surface of the panels of the carton blank 2' 2*a'*, 2*b'*, 2*c'*, 2*d'*, 2*g'* (which are to be the side panels 2*a*, 2*b*, 2*c*, 2*d* and the inclined panel 2*g*). While the carton blank 2' is being formed, as shown in FIG. 4, a sheet film is folded into a tubular shape and back-sealed at end portions to form a back-sealed portion 16. The folded film is cut into tubular films 3' of a required length (whose top and bottom ends will be sealed in a later step into the inner bags).

Then, an adhesive, e.g., an emulsion-type adhesive, as of vinyl acetate group, acryl copolymer group, vinyl acetate-acryl copolymer group, modified ester acrylate copolymer group, etc., is applied to the inner-bag adhering regions 9 which are formed on the substantially entire inside surfaces of the panels 2*a'*, 2*b'*, 2*d'* and 2*g'* of the carton blank 2'. The adhesive is applied to the inner-bag adhering regions 9 formed partially on the side panel 2*c'* and a glue margin 2*h'* of the carton blank 2'. The glue margin 2*h'* is a part forming the side panel 2*b* of the carton 2, and the inner-bag adhering regions 9 on the glue margin 2*h'* includes an unrelesable region 9*a* and a releasable region 9*b*. The emulsion-type adhesive is also applied to the back side of the glue margin 2*h'*.

A glue margin 2*i'* of the carton blank 2' is folded inside when the carton blank 2' is set up, and a hot-melt adhesive, as of ethylene-vinyl acetate copolymer group, polyvinyl acetate group, polyamide roup, polyethylene group, styrene-butadiene copolymer group, styrene-isobutylene copolymer group, polyisobutylene group, polyester group, etc., is also applied to the glue margin 2*i'*.

Then, as shown in FIG. 15, the tubular film 3' is adhered to the panels 2*a'*, 2*d'*, 2*g'* of the carton blank 2' by means of an adhesive. The tubular film 3' is so arranged that the back-sealed portion 16 is in abutment on the side panel 2*c* and is opposed to the pouring spout 5 when the carton blank 2' is set up. Then, the side panels 2*b'*, 2*c'* are folded on the tubular film 3' and barrel-sealed. The panels 2*b'*, 2*c'* and the glue margin are adhered to the tubular film 3', and the panels 2*b'* are adhered. Thus a flat bag-in-carton before being set up is formed.

Then, the flat bag-in-carton 1 is fed to the setting-up step portion and the loading step portion, and is set up there into a rectangular parallelepiped and completed one. Then, a pouring spout attached portion 15 (FIG. 15) of the carton blank 27 is punched, and the pouring spout 5 is attached. Then, the upper end of the tubular film 3' is seal-closed.

After the upper end of the tubular film 3' is sealed, the top of the carton blank 2' is set up.

Then, the lower end of the tubular film 3' is sealed in the same way as the upper end thereof, and then the bottom of the carton blank 2' is set up. And the bag-in-carton 1 accommodating the inner bag 3 in the carton 2 is set up. This process can be conducted by the conventional bag-in-carton forming technique, and the forming equipments, etc. are not explained. Finally a content 4, such as ink or others, is loaded in the bag-in-carton 1, and the bag-in-carton 1 has the state shown in FIG. 14.

In using the bag-in-carton filled with a content 4, as shown in FIGS. 11A and 11B, the bag-in-carton is set on a machine, such as a printing machine or others, with the pouring spout directed downward, and the pouring spout is connected to a connector (not shown) of drawing means belonging to the machine. The content 4 is drawn and discharged through the pouring spout 5. At this time, the inner bag 3 starts being released from the inner-bag adhering regions 9 on the side panel 2*c*, which are spot-adhesions, and then from the pair of opposed side panels 2*b*, 2*d*. As the content 4 is drawn, the released parts of the inner bag 2 is deformed as shown by the two-dot lines 21*a*, 21*b* in FIG. 11B and is displaced to the pouring spout 5, whereby the content 4 can be discharged in a stably constant amount without letting air into the inner bag 3. Finally the released part of the inner bag 3 is withdrawn into the unreleasable part thereof, which is fixed to the inside surfaces of the carton 2 and are substantially a rest half of the inner bag 3, and almost all the content is discharged.

Next, the adhesive strength of the releasable part 9*a* and the unreleasable part 9*a* will be explained.

Adhesive strengths of the releasable part 9*b* and the unreleasable part 9*a* are substantially as follows.

An adhesive strength (a force (gf) 15 mm-width samples required to be released when subjected to a tensile test at the room temperature) is

- a strength of the releasable part 9*b* at the start of the release: about 470 gf
- an adhesive strength of the releasable part 9*b*: about 210 gf It is preferable that the unreleasable part 9*a* has a higher adhesive strength than that of the releasable part 9*b*.

As described above, according to the present embodiment, when the content 4 is drawn out through the pouring spout 5, the inner bag 3 starts being released first from the inner-bag adhering regions 93, to which the inner bag 3 is spot adhered, and then from the inside surfaces of the one pair of the side panels 2*b*, 2*d*, and is gradually deformed and displaced to the pouring spout 5. Then, the released part of the inner bag 3 is withdrawn into the unreleasable part thereof, whereby substantially all the content 4 can be drawn out through the pouring spout 5.

Because of the recesses 19 having the openings 19*a* directed to the remote end part 20 (see FIGS. 11A and 11B) provided on the parts of the inner-bag adhering regions 9 on the pair of side panels 2*b*, 2*d*, which (parts) are on the side of the remote end part 20, the inner bag 3 can be readily released from the pair of side panels 2*b*, 2*d* first on the side of the remote part 20 when the inner bag 3 is released from the inside surfaces of the carton 2.

The back sealed portion 16 on the inner bag 3 abuts on the side panel 2*c* and is opposed to the pouring spout 5. This arrangement enables the content 4 of the inner bag 3 to be driven to the pouring spout without failure when the inner bag 3 is deformed, displaced to the pouring spout 5 as the content 4 is drawn out.

That is, the back sealed portion 16 of the inner bag 3, which is harder than the rest part of the inner bag 3, tends to hinder the deformation when the inner bag 3 is deformed. Accordingly in a case where the back sealed portion 16 abuts on, e.g., the side panel 2*b*, which is adjacent to the inclined panel 2*g* (the pouring spout attached panel), the back sealed portion 16 hinders the deformation of the inner bag 3 with a possible result where the inner bag 3 may be deformed horizontally unsymmetrically with respect to the pouring spout 5.

According to the present invention, because the back sealed portion 16 is located opposed to the pouring spout 5, the inner bag 3 can be deformed horizontally symmetrically with respect to the pouring spout 5 as a center, whereby the content 4 of the inner bag 3 can be smoothly sent out to the pouring spout without unsymmetrical deformation.

Next, another embodiment of the present invention will be explained with reference to FIG. 16. The embodiment shown in FIG. 16 is substantially the same as the embodiment shown in FIGS. 14 and 15 except that the inner-bag adhering regions have different shapes from those of the embodiment shown in FIGS. 14 and 15.

Figure 16:
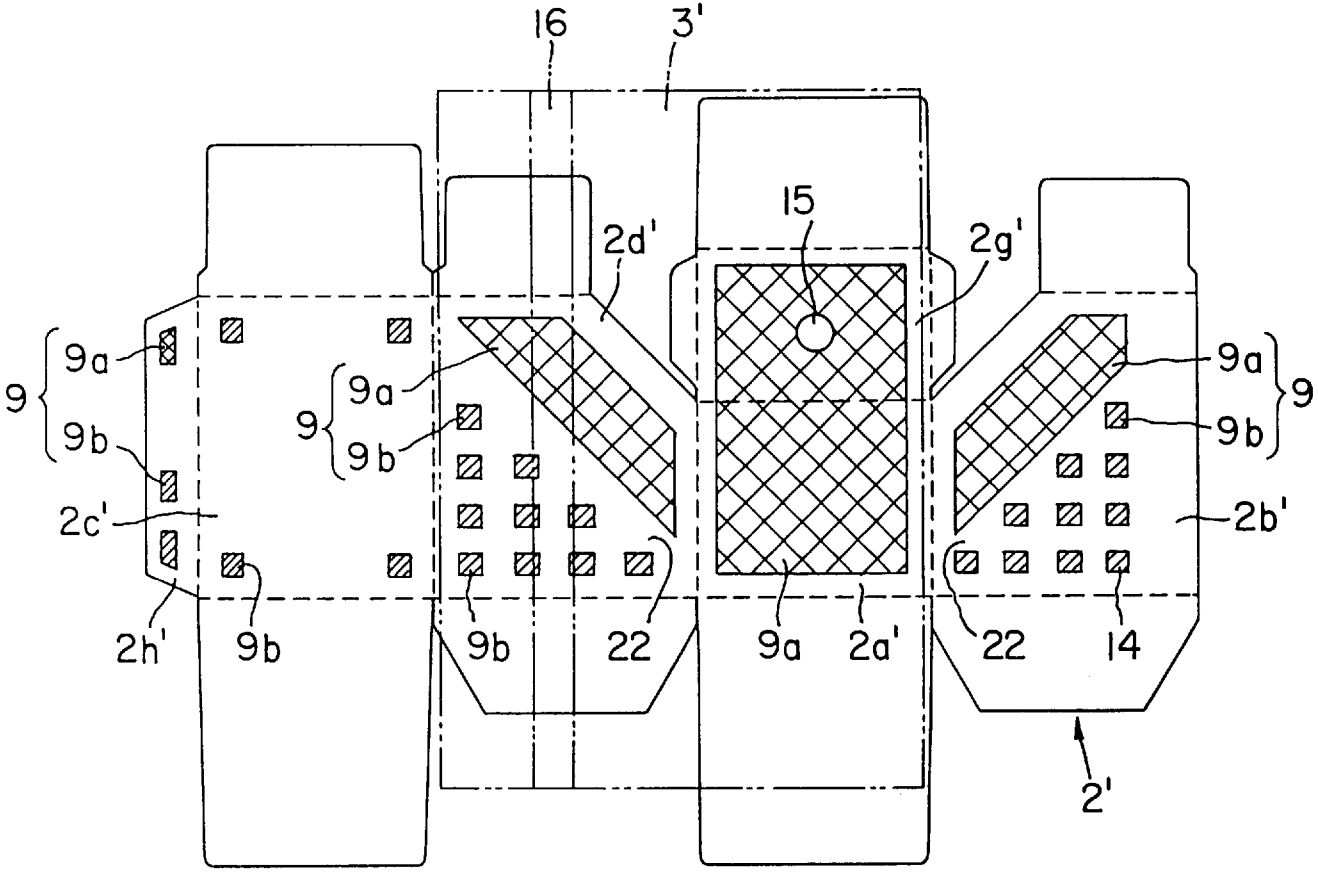
FIG. 16 is the same view of bag-in-carton according to another embodiment of the present invention as FIG. 15.

As shown in FIG. 16, a tubular film 3' (to be the inner bag 3) is adhered to the substantially entire parts of side panels 2*b'*, 2*d'* (to be one pair of side panels 2*b*, 2*d*), which (parts) are on the side of a pouring spout 5 with respect to an middle part 22 which is formed on the substantially middle of a straight line 21 (FIGS. 11A and 11B) interconnecting the pouring spout 5 and a remote end part 20 of the carton 2 and is normal to the straight line 21. The tubular film 3' is spot-adhered to a plurality of spots 14 on the parts of the side panels 2*b'*, 2*d'* which (parts) are on the side of the remote end part 20 with respect to the middle part 22.

In FIG. 16, the inner-bag adhering regions provided on the substantially entire parts of the side panels 2*b'*, 2*d'* on the side of the pouring spout 5 are unreleasable regions 9*a*. The plural spotted inner-bag adhering regions 14 provided on the part of the side panels 2*b'*, 2*d'* on the remote end part 20 are releasable regions 9*b*. The inner-bag adhering regions 9 include a releasable region 9*a* and an unreleasable region 9*b*.

As shown in FIG. 16, the tubular film 3' is spot-adhered to plural spots 14 on the parts of the side panels 2*b'*, 2*d'*on the side of the remote end part 20 with respect to the middle part 22, whereby the inner bag can be readily released from the pair of side panels 2*b*, 2*d* first from the side of the remote end part when the inner bag 3 is released from the inside surfaces of the carton 2.

Then further another embodiment of the present invention will be explained with reference to FIGS. 17A to 19D. The embodiment shown in FIGS. 17A to 19C is substantially the same as the embodiment shown in FIGS. 14 and 15 except that the inner-bag adhering regions on the pair of side panels 2b', 2d' (to be the pair of side panels 2b, 2d opposed to each other) have different shapes from those of the embodiment shown in FIGS. 14 to 15.

In FIGS. 17A to 19C, for simplification of explanation, only the side panel 2b' of the pair of side panels 2b', 2d' will be explained, but shapes of inner-bag adhering region on the side panel 2d' are symmetrical with those of the inner-bag adhering region on the side panel 2b'.

Figure 17A:
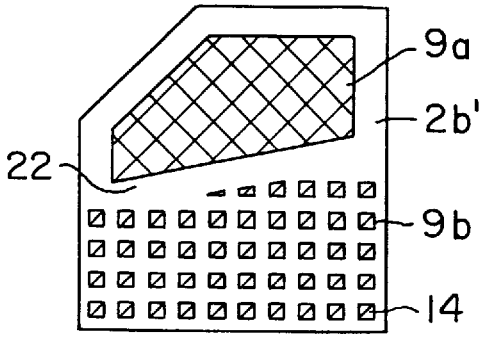
FIG. 17A is a view of inner-bag adhering regions of the bag-in-carton according to further another embodiment of the present invention and shows only a side panel for convenience.

As shown inn FIG. 17A, a tubular film 3' (see FIG. 15) is adhered to the substantially entire part of the inside surface of the side panel 2b', which (part) is on the side of a middle part 22 which is formed on the substantially middle part of a straight line 21 interconnecting the pouring spout 5 and a carton 2 (FIGS. 11A and 11B) and is normal to the straight line 21. The tubular film 3' is spot-adhered to a plurality of spots 14 on the part of the side panel 2b' on the side of the remote end part 30 with respect to the middle part 22.

In FIG. 17A, the inner-bag adhering regions provided on the substantially entire part of the side panel 2b' on the side of the pouring spout 5 are an unreleasable region 9a, and the inner-bag adhering regions of the side panel 2b' on the side of the remote end part 20 in the form of the plural spots are releasable regions 9b. As shown in FIG. 17A, the plural spot: regions are respectively rectangular.

Figure 17B:
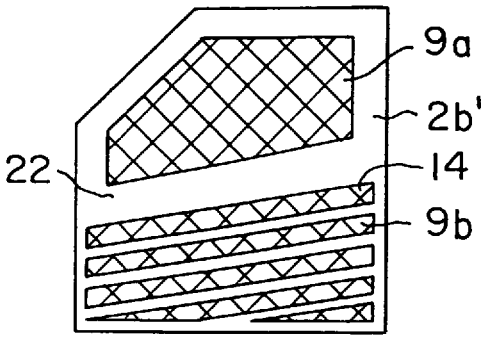
FIG. 17B is a view of inner-bag adhering regions of the bag-in-carton according to further another embodiment of the present invention and shows only a side panel for convenience.

The plural spots 14 may be formed in a shape of strips each having the same width and their areas may be decreased toward the side of the remote end part 20 (FIG. 17B). The decrease of areas toward the side of the remote end part 20 facilitates the release of the inner bag 3 first from the side of the remote end part 20.

Figure 17C:
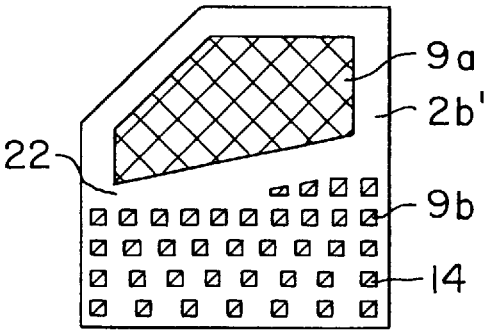
FIG. 17C is a view of inner-bag adhering regions of the bag-in-carton according to further another embodiment of the present invention and shows only a side panel for convenience.

It is also possible that the plural spots 14 are formed in rectangles of the same size and decrease their number toward the remote end part 20 (to lower right side) (FIG. 17C).

Figure 17D:
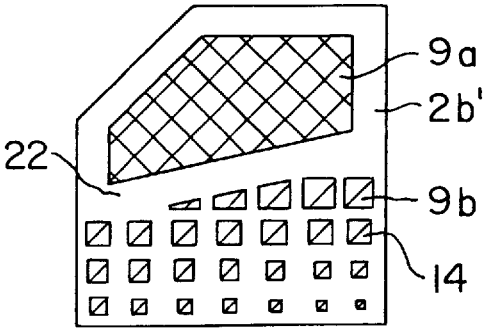
FIG. 17D is a view of inner-bag adhering regions of the bag-in-carton according to further another embodiment of the present invention and shows only a side panel for convenience.

It is also possible that the plural spots 14 may be formed in rectangles and gradually decrease their areas toward the remote end part 20 (lower right side ) (FIG. 17D).

Figure 17E:
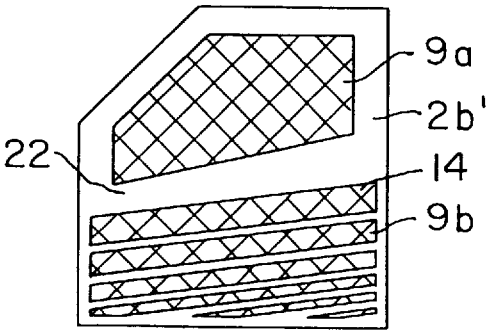
FIG. 17E is a view of inner-bag adhering regions of the bag-in-carton according to further another embodiment of the present invention and shows only a side panel for convenience.

As shown in FIG. 17E, the plural spots 14 may be formed in a shape of strips, and their widths and areas may be decreased toward the side of the remote end part (lower right side).

Figure 17F:
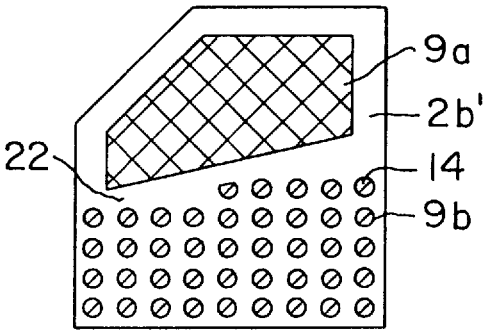
FIG. 17F is a view of inner-bag adhering regions of the bag-in-carton according to further another embodiment of the present invention and shows only a side panel for convenience.

As shown in FIG. 17F, the plural spots 14 may be respectively formed in a round shape.

Figure 18A:
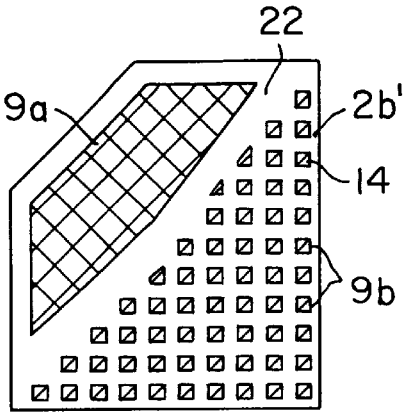
FIG. 18A is a view of inner-bag adhering regions of the bag-in-carton according to further another embodiment of the present invention and shows only a side panel for convenience.

As shown in FIG. 18A, the tubular film 3' is adhered to the substantially entire part of the inside surface of the side panel 2b' which (part) is on the side of the pouring spout 5 with respect to the middle part 22, and is adhered to a plurality of spots 14 of the part of the inside surface on the side of the remote end part 20. In FIG. 18A, the inner-bag adhering region provided on the substantially entire part of the side panel 2b' on the side of the pouring spout 5 is an unreleasable region 9a and has the edge on the side of the middle part 22 which is bent. The plural spots 14 on the side of the side panel 2b' on the side of the remote end part 20 are releasable regions 9b, and each has a rectangular shape.

Figure 18B:
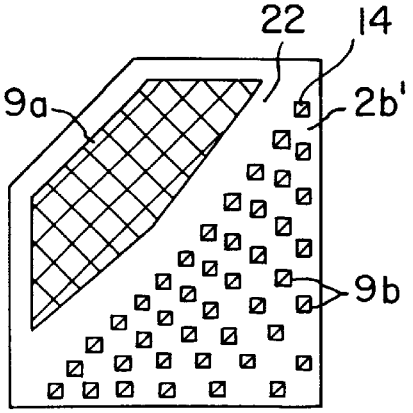
FIG. 18B is a view of inner-bag adhering regions of the bag-in-carton according to further another embodiment of the present invention and shows only a side panel for convenience.

The plural spots 14 may be a rectangle of the same size or may gradually decrease their number toward the side of the remote end part 20 (lower right side) (FIG. 18B).

Figure 18C:
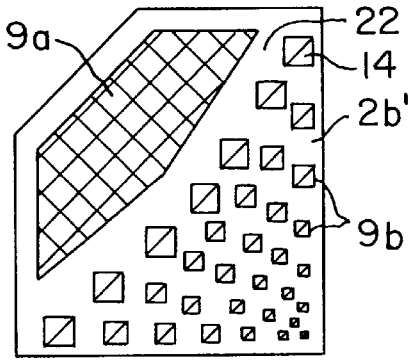
FIG. 18C is a view of inner-bag adhering regions of the bag-in-carton according to further another embodiment of the present invention and shows only a side panel for convenience.

The plural spots 14 may be formed in rectangles and gradually decrease their areas toward the side of the remote end part 20 (lower right side) (FIG. 18C).

Figure 18D:
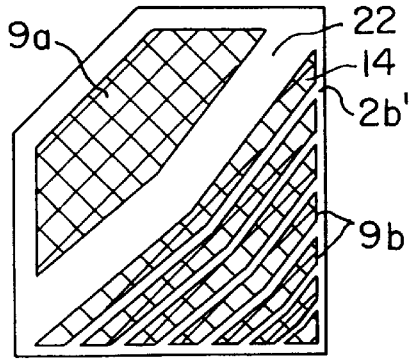
FIG. 18D is a view of inner-bag adhering regions of the bag-in-carton according to further another embodiment of the present invention and shows only a side panel for convenience.

As shown in FIG. 18D, the plural spots 14 may be formed in a shape of strips, each having the same width and gradually decrease their areas toward the side of the remote end part 20 (lower right side).

Figure 18E:
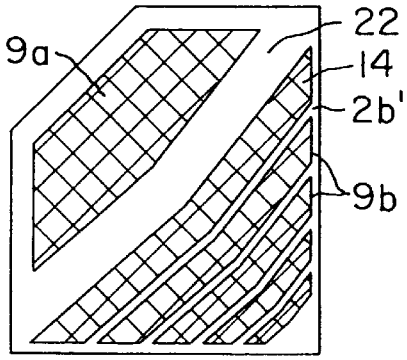
FIG. 18E is a view of inner-bag adhering regions of the bag-in-carton according to further another embodiment of the present invention and shows only a side panel for convenience.

As shown in FIG. 18E, the plural spots 14 may be formed respectively in a shape of strips and decrease their widths and areas toward the side of the remote end part 20 (lower right side).

Figure 18F:
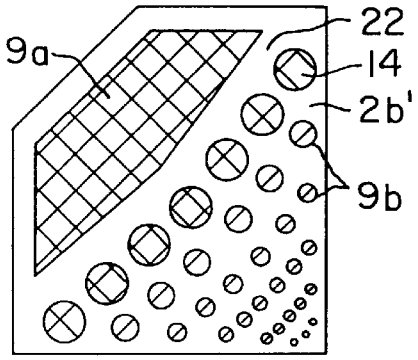
FIG. 18F is a view of inner-bag adhering regions of the bag-in-carton according to further another embodiment of the present invention and shows only a side panel for convenience.

As shown in FIG. 18F, the plural spots 14 may be formed respectively in a round shape and gradually decrease their areas toward the side of the remote end part 20.

Figure 19A:
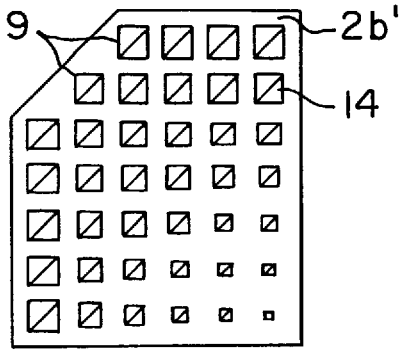
FIG. 19A is a view of inner-bag adhering regions of the bag-in-carton according to further another embodiment of the present invention and shows only a side panel for convenience.

As shown in FIG. 19A, the tubular film 3' is adhered to the inside surface of the panel 2b' in the inner-bag adhering regions 9. The inner-bag adhering regions 9 are in a form of a plurality of spots 14. The respective spots 14 are formed respectively in rectangles and gradually decrease their areas toward the side of the remote end part 20 (lower right side). Those of the inner-bag adhering regions 9 on the side of the pouring spout 5 (upper left side) are unreleasable regions, and those of the inner-bag adhering regions 9 on the side of the remote end part 20 (lower right side) are releasable regions.

Figure 19B:
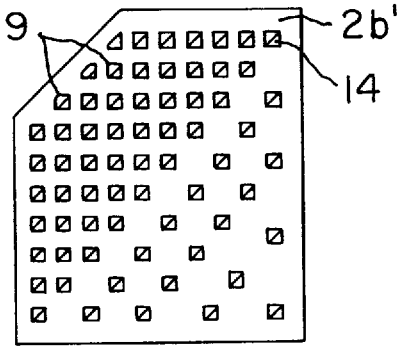
FIG. 19B is a view of inner-bag adhering regions of the bag-in-carton according to further another embodiment of the present invention and shows only a side panel for convenience.

As shown in FIG. 19B, the plural spots 14 may be formed respectively rectangles of the same size and gradually decrease their numbers toward the side of the remote end part (lower right side).

Figure 19C:
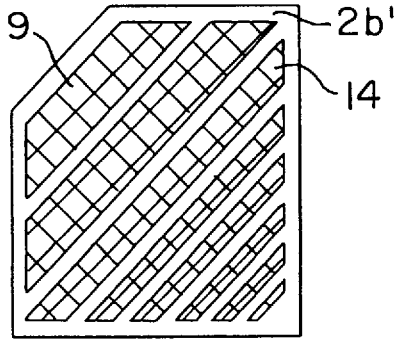
FIG. 19C is a view of inner-bag adhering regions of the bag-in-carton according to further another embodiment of the present invention and shows only a side panel for convenience.

As shown in FIG. 19C, the plural spots 14 may be formed respectively in a form of strips and decrease their widths toward the side of the remote end part 20 (lower right side).

As shown in FIG. 19C, the plural spots 14 are formed in a form of strips and decrease their widths toward the side of the remote end part 20 (lower right side).

In the above-described embodiments, the pouring spout 5 unessentially has the tubular portion 5a which is extended into the inner bag 3, and may be a usual one without the tubular portion. It is possible that a suitable passage member (e.g., a rod member of H-section or others) which ensures flow passage of the content even when the releasable part of the inner bag 3 is withdrawn in the unreleasable part thereof is provided on the bottom of the inner bag 3.

In the above-described embodiments, the bag-in-carton 1 is set on a machine with the pouring spout 5 faced downward, but this state is not essential to discharge the content of the bag-in-carton 1. Depending on machines on which the bag-in-carton 1 is set, the pouring spout 5 may be faced suitably sideways or upward. In a case that the bag-in-carton 1 is set on a machine with the pouring spout 5 faced upward, run of the content at the pouring spout can be prevented.

As described above, according to the present invention, when the inner bag 2 is released from the inside surfaces of the carton 2 as the content decreases, the inner bag 3 can be readily released from the pair of side panels 2a, 2d first from the side of the remote end part 20. Accordingly the inner bag 3 can be deformed in the carton 2.

What is claimed is:

1. A bag-in-carton comprising:

a substantially rectangular parallelepiped carton having a pouring spout mounting panel;

a flexible inner bag disposed in the carton, for holding a content; and a pouring spout mounted on the pouring spout mounting panel of the carton and passed through the inner bag and the pouring spout mounting panel, wherein the inner bag is fixed by an adhesive to, of insides of the carton, a substantially entire surface of the inside of the pouring spout mounting panel of the carton and substantially entire surfaces of the insides of a pair of the opposed side panels which are adjacent to the pouring spout mounting panel, the inner bag being gradually released off the insides of the carton as the content is discharged out of the inner bag.

2. The bag-in-carton according to claim 1, wherein an inclined side panel is formed between a pair of adjacent side panels of the substantially rectangular parallelepiped carton, and the inclined panel is the pouring spout mounting panel.

3. The bag-in-carton according to claim 1, wherein the inner bag is adhered to the substantially entire surface of the inside of the pouring spout mounting panel.

4. The bag-in-carton according to claim 1, wherein the inner bag is adhered partially to an inside of a side panel which is not adjacent to but remote from the pouring spout mounting panel.

5. The bag-in-carton according to claim 4, wherein the inner bag is adhered partially to four corners of the inside of the side panel which is not adjacent to but remote from the pouring spout mounting side.

6. The bag-in-carton according to claim 1, wherein boundaries of inner-bag adhering regions on the pair of opposed side panels are formed in a shape of concavities and convexities.

7. The bag-in-carton according to claim 6, wherein parts of the boundaries of the inner-bag adhering regions, which are remote from the pouring spout are formed in concavities and convexities.

8. The bag-in-carton according to claim 1, wherein the inner bag is formed of a tubular film which is prepared by folding a sheet of film into a tubular shape and sealing end edges thereof into a back sealed portion, the back sealed portion of the tubular film is disposed inside the panel of the carton opposed to the pouring spout mounting panel.

9. The bag-in-carton according to claim 8, wherein the pouring spout is disposed substantially at the center of the pouring spout mounting panel, and the back sealed portion is disposed substantially at the center of a panel opposed to the pouring spout mounting panel.

10. A bag-in-carton comprising:

a substantially rectangular parallelepiped carton having a pouring spout mounting panel;

a flexible inner bag disposed in the carton, for holding a content; and a pouring spout mounted on the pouring spout mounting panel of the carton and passed through the inner bag and the pouring spout mounting panel, wherein the carton has one closed side portion and the other closed side portion which are opposed to each other;

the inner bag has one seal-closed side portion and the other seal-closed side portion which correspond respectively to said one closed side portion of the carton and said other closed side portion thereof; and said one seal-closed side portion of the inner bag has a shape corresponding to that of said one closed side portion of the carton.

11. The bag-in-carton according to claim 10, wherein the inner bag is secured by an adhesive to, of the insides of the carton, the substantially entire surface of the inside of the pouring spout mounting panel of the carton and to the substantially entire surfaces of the insides of the pair of opposed side panels which are adjacent to the pouring spout mounting panel, the inner bag is gradually released off the insides of the carton as the content is discharged.

12. The bag-in-carton according to claim 11, wherein an inclined panel is formed between a pair of adjacent side panels of a substantially square parallelepiped carton, and the inclined panel is the pouring spout mounting panel.

13. The bag-in-carton according to claim 11, wherein the inner bag is adhered partially to an inside of a side panel which is not adjacent to but remote from the pouring spout mounting side.

14. A bag-in-carton comprising:

a substantially rectangular parallelepiped carton having a pouring spout mounting panel;

a flexible inner bag disposed in the carton, for holding a content; and a pouring spout mounted on the pouring spout mounting panel of the carton and passed through the inner bag and the pouring spout mounting panel, wherein the inner bag is secured by an adhesive to, of insides of the carton, a substantially entire surface of the inside of the pouring spout mounting panel;

the inner bag is adhered to surfaces of a pair of opposed side panels of the carton, that are adjacent to the pouring spout mounting panel, except strips of the surfaces that are substantially normal to a straight line interconnecting the pouring spout and a remotest end part of the carton that are remotest from the pouring spout, and are located at a middle of the straight line, the inner bag is gradually released off the insides of the carton as the content is discharged.

15. The bag-in-carton according to claim 14, wherein the inner bag is adhered partially to an inside of a panel of the carton, which is not adjacent to the pouring spout mounting panel.

16. A bag-in-carton comprising:

a substantially rectangular parallelepiped carton having a pouring spout mounting panel;

a flexible inner bag disposed in the carton, for holding a content; and a pouring spout mounted on the pouring spout mounting panel of the carton and passed through the inner bag and the pouring spout mounting panel, wherein the inner bag is secured by an adhesive to, of insides of the carton, a substantially entire surface of an inside of the pouring spout mounting panel;

the inner bag is adhered to surfaces of a pair of opposed side panels of the carton, that are adjacent to the pouring spout mounting side, except recesses in the surfaces that are extended substantially parallel with a straight line interconnecting the pouring spout and a remotest end part of the carton from the pouring spout, the inner bag is gradually released off the insides of the carton as the content is discharged.

17. The bag-in-carton according to claim 16, wherein the recesses formed in the pair of opposed side panels are disposed in regions of the pair of opposed side panels which are near the remote end portion.

18. A bag-in-carton comprising:

a substantially rectangular parallelepiped carton having a pouring spout mounting panel;

a flexible inner bag disposed in the carton, for holding a content; and a pouring spout mounted on the pouring spout mounting panel of the carton and passed through the inner bag and the pouring spout mounting panel, wherein the inner bag is secured by an adhesive to, of insides of the carton, a substantially entire surface of the inside of the pouring spout mounting panel;

the inner bag is adhered to the insides of a pair of opposed side panels of the carton, that are adjacent to the pouring spout mounting panel, the inner bag being adhered to substantially the entire surface of the insides of the pair of opposed side panels on the side of the pouring spout with respect to a substantial middle of a straight line interconnecting the pouring spout and a remotest end part of the carton that are remotest from the pouring spout, and the inner bag being adhered partially to surfaces of the insides of the pair of opposed side panels on the side of the remotest end part, the inner bag is gradually released off the insides of the carton as the content is discharged.

19. The bag-in-carton according to claim 18, wherein the inner-bag adhering surfaces of the insides of the pair of opposed side panels, on the side of the remotest side panel, have areas gradually decreased from the pouring spout to the remote end part.

20. The bag-in-carton according to claim 18, wherein the inner-bag adhering surfaces of the pair of opposed side panels on the side of the remotest end part, have respective areas gradually decreased from the pouring spout to the remote end part.

21. The bag-in-carton according to claim 18, wherein the inner-bag adhering surfaces of the insides of the pair of opposed side panels, on the side of the remotest end part have parts, the numbers of the parts being gradually decreased from the pouring spout to the remote end part.

22. A bag-in-carton comprising:

a substantially rectangular parallelepiped carton having a souring spout mounting panel;

a flexible inner bag disposed in the carton, for holding a content; and a pouring spout mounted on the pouring spout mounting panel of the carton and passed through the inner bag and the pouring spout mounting panel, wherein the inner bag is fixed to a. substantially entire surface of an inside of the pouring spout mounting side panel of the carton;

the inner bag is adhered to the insides of a pair of opposed side panels of the carton, that are adjacent to the pouring spout mounting side panel, in such a manner where the inner-bag adhering surfaces have areas decreasing gradually from the pouring spout to the remote end part, the inner bag is released off the insides of the carton as the content is discharged.

23. The bag-in-carton according to claim 22, wherein the inner-bag adhering surfaces of the insides of the pair of opposed sides are constituted by a plurality of parts, areas of the respective parts decreasing gradually from the pouring spout to the remote end part.

24. The bag-in-carton according to claim 22, wherein the inner-bag adhering surfaces of the insides of the pair of opposed sides are constituted by a plurality of parts, numbers of the respective parts decreasing gradually from the pouring spout to the remote end part.

* * * * *